US005176122A

United States Patent [19]

Ito

[11] Patent Number: 5,176,122

[45] Date of Patent: Jan. 5, 1993

[54] FUEL INJECTION DEVICE FOR AN INTERNAL COMBUSTION ENGINE

[75] Inventor: Yasushi Ito, Susono, Japan

[73] Assignee: Toyota Jidosha Kabushiki Kaisha, Toyota, Japan

[21] Appl. No.: 798,514

[22] Filed: Nov. 26, 1991

[30] Foreign Application Priority Data

Nov. 30, 1990 [JP] Japan ..... 2-333617
Nov. 30, 1990 [JP] Japan ..... 2-333619

[51] Int. Cl.[5] ..... F02D 41/04; F02M 51/00

[52] U.S. Cl. ..... 123/478; 123/447; 123/458; 123/494

[58] Field of Search ..... 123/445, 447, 454, 458, 123/478, 480, 494, 511

[56] References Cited

U.S. PATENT DOCUMENTS 4,841,936 6/1989 Takahashi ..... 123/447
4,890,593 1/1990 Goulet ..... 123/478 X
4,955,339 9/1990 Sasaki et al. ..... 123/478 X
4,958,610 9/1990 Yamamoto et al. ..... 123/478
5,012,780 5/1991 Bugamelli ..... 123/478 X
5,058,553 10/1991 Kondo et al. ..... 123/458 X
5,090,379 2/1992 Ito ..... 123/299
5,101,785 4/1992 Ito ..... 123/357
5,127,378 7/1992 Ito ..... 123/300

FOREIGN PATENT DOCUMENTS 159524 12/1981 Japan ..... 123/458
62-186034 8/1987 Japan .

*Primary Examiner*—Willis R. Wolfe
*Attorney, Agent, or Firm*—Kenyon & Kenyon

[57] ABSTRACT

A fuel injection device for an internal combustion engine having a fuel injector connected to a discharge port of a fuel supply pump, via a fuel passage, wherein a fuel pressure drop detecting unit detects a drop in the fuel pressure in the fuel passage caused by a plurality of fuel injections, while a fuel supply unit has stopped the supply of fuel from the fuel supply pump to the fuel passage, and a correction unit corrects an amount of fuel to be injected, to thereby make an actual total amount of fuel injection, determined on the basis of the fuel pressure drop, identical to a total of a target amount of fuel to be injected.

21 Claims, 24 Drawing Sheets

| |
|---|
| Fig. 15A |
| Fig. 15B |
| Fig. 15C |

| |
|---|
| Fig. 20A |
| Fig. 20B |
| Fig. 20C |

FUEL INJECTION DEVICE FOR AN INTERNAL COMBUSTION ENGINE

BACKGROUND OF THE INVENTION

1. Field of the invention

The present invention relates to a fuel injection device for an internal combustion engine.

2. Description of the Related Art

The amount of fuel injected by individual fuel injectors usually differs at each injector, even if a fuel pressure and fuel injection time at each fuel injector are the same, and thus the actual amount of fuel injected differs at each cylinder of the engine. Also, the actual amount of fuel injected is changed by a long-term operation of the fuel injectors, even if the fuel pressure and the fuel injection time are constant. Accordingly, it is difficult to equalize the actual amount of fuel injected with a target amount of fuel injected, when this is calculated on the basis of an engine speed and an engine load.

To solve this problem, Japanese Unexamined Patent Publication No. 62-186034 discloses a device for controlling an amount of fuel to be injected to an internal combustion engine, wherein a discharge port of a fuel supply pump is connected to a fuel injector via a reservoir tank, a basic amount of fuel to be injected is calculated on the basis of the engine speed and the engine load, a difference in a fuel pressure before and after one fuel injection is determined on the basis of an output of a fuel pressure sensor for detecting a fuel pressure in the reservoir tank, the actual amount of fuel to be injected is calculated on the basis of the difference in the fuel pressure, and the basic amount of fuel to be injected is corrected to obtain the actual amount of fuel to be injected.

In this device, however, since fluctuations in the fuel pressure in the reservoir tank are large, relative to an amount of drop of the fuel pressure in the reservoir tank caused by one fuel injection, the amount by which the fuel pressure in the reservoir tank has dropped can not be precisely detected. Therefore a problem arises in that the actual amount of fuel to be injected can not be precisely determined, and thus the actual amount of fuel to be injected can not be made equal to the calculated target amount of fuel to be injected.

SUMMARY OF THE INVENTION

An object of the present invention is to provide a fuel injection device for an internal combustion engine, by which the amount of fuel to be injected is made identical to the target amount of-fuel to be injected.

According to the present invention, there is provided a fuel injection device for an internal combustion engine having a fuel injector connected to a discharge port of a fuel supply pump via a fuel passage, the device comprising: a calculating means for calculating a target amount of fuel to be injected, on the basis of an engine speed and an engine load; a fuel pressure detecting means for detecting a fuel pressure in the fuel passage; a fuel supply stopping means for stopping a supply of fuel from the fuel supply pump to the fuel passage; a fuel pressure drop detecting means for detecting an amount by which the fuel pressure drops in the fuel passage when a plurality of fuel injections are carried out, on the basis of an output of said fuel pressure detecting means while the fuel supply stopping means stops the supply of fuel; an actual total amount of fuel injected determining means for determining an actual total amount of fuel injected on the basis of the amount of drop in the fuel pressure detected by the fuel pressure drop detecting means; a correction means for correcting an amount of fuel to be injected to thereby make the actual total amount of fuel injected identical to a total of the target amount of fuel to be injected on the basis of a result of said actual total amount of fuel injected determining means; and a fuel supply starting means for starting a supply of fuel from the fuel supply pump to the fuel passage when the fuel pressure drop detecting means has detected the amount of drop in the fuel pressure.

The present invention may be more fully understood from the description of preferred embodiments of the invention set forth below, together with the accompanying drawings.

DESCRIPTION OF THE PREFERRED EMBODIMENTS

Figure 1:
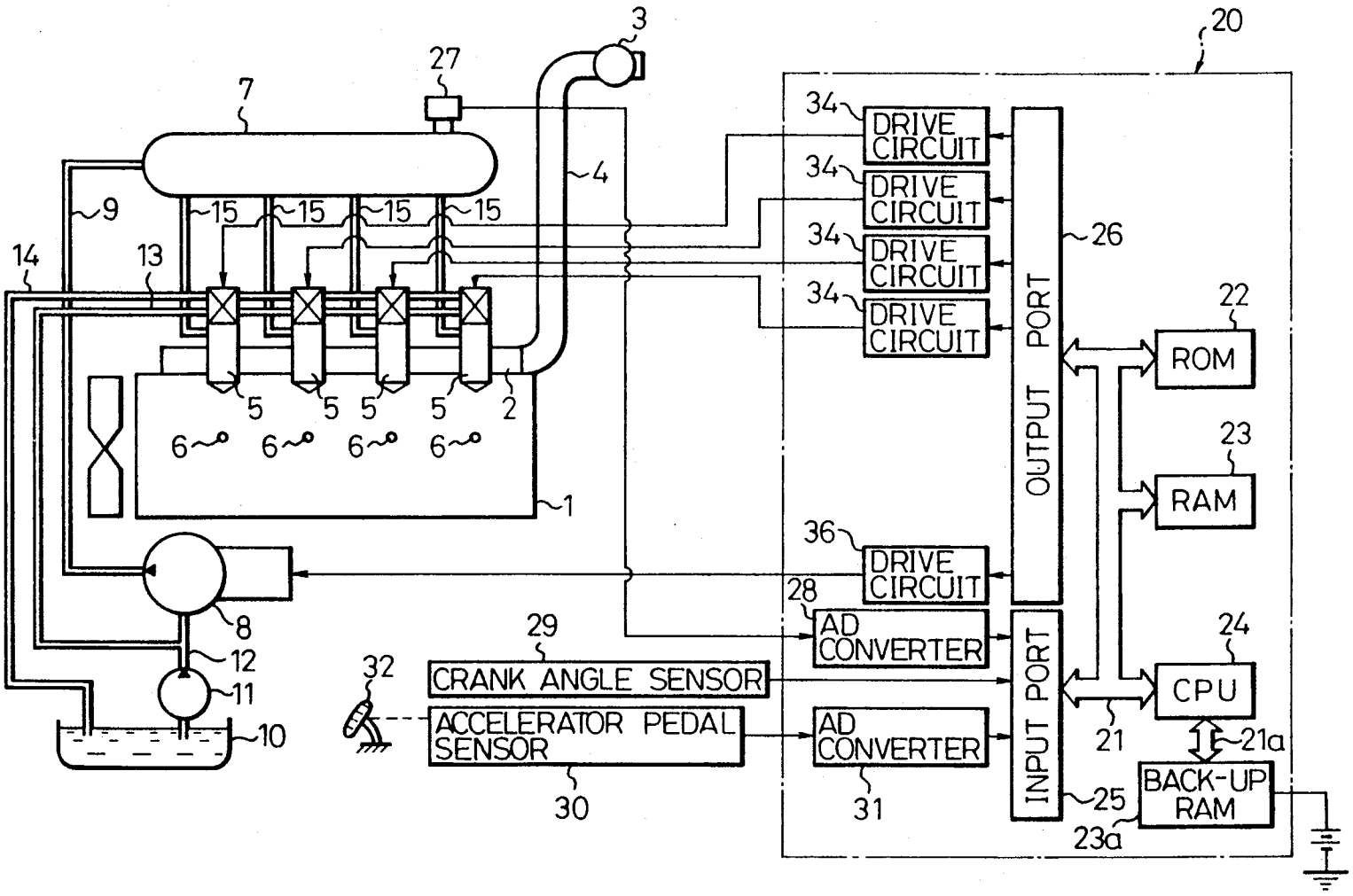
FIG. 1 is a schematic view of a four-cylinder gasoline engine.

Referring to FIG. 1, reference numeral 1 designates an engine body, 2 a surge tank, 3 an air cleaner, 4 an intake pipe, 5 fuel injectors, 6 spark, plugs, and 7 a reservoir tank. The intake pipe 4 connects the surge tank 2 to the air cleaner 3, and a low pressure fuel pump 11 supplies fuel from a fuel tank 10 to a high pressure fuel pump 8 via a conduit 12. The high pressure fuel pump 8 supplies a high pressure fuel to the reservoir tank 7 via a high pressure conduit 9. The conduit 12 is connected to a cooling pipe 13 for cooling the piezoelectric elements of each fuel injector 5, and the cooling pipe 13 is connected to the fuel tank 10 via a return pipe 14. Each fuel supply pipe 15 connects each fuel injector 5 to the reservoir tank 7.

The electronic control unit 20 is constructed as a digital computer and includes a ROM (read only memory) 22, a RAM (random access memory) 23, a CPU (microprocessor, etc.) 24, an input port 25, and an output port 26. The ROM 22, the RAM 23, the CPU 24, the input port 25 and the output port 26 are interconnected via a bidirectional bus 21, and the CPU 24 is connected to a back up RAM 23*a* via a bidirectional bus 21*a*. A pressure sensor 27 for detecting a pressure in the reservoir tank 7 is connected to the input port 25 via an AD converter 28. A crank angle sensor 29 generates a pulse at predetermined crank angles, and the pulse at predetermined crank angles, and the pulses output by the crank angle sensor 29 are input to the input port 25, and accordingly, an engine speed is calculated on the basis of the pulses output by the crank angle sensor 29. An accelerator pedal sensor 30 for detecting a degree of opening $\theta A$ of an accelerator pedal 32 is connected to the input port 25 via AD converter 31.

Each fuel injector 5 is connected to the output port 26 via corresponding drive circuits 34 and the high pressure fuel pump 8 is connected to the output port 26 via a drive circuit 36.

Figure 2:
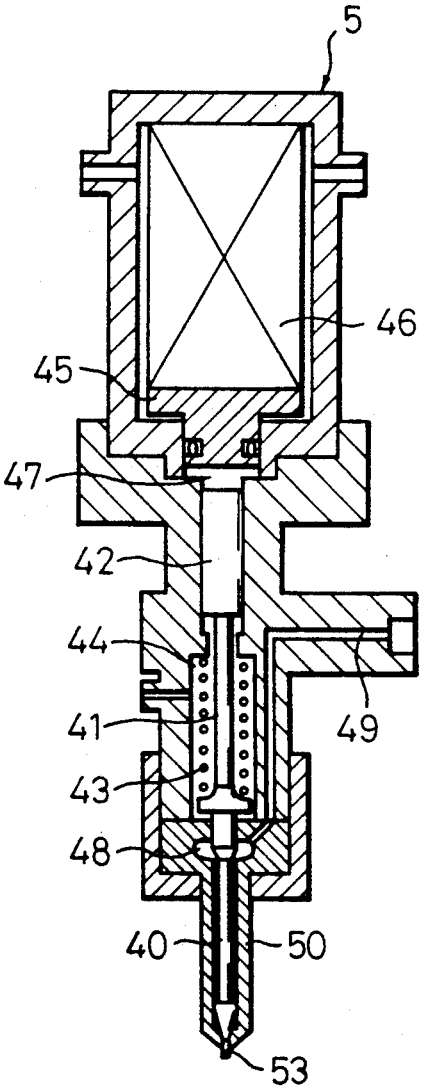
FIG. 2 is a cross-sectional side view of a fuel injector.

FIG. 2 illustrates the fuel injector 5. Referring to FIG. 2, reference numeral 40 designates a needle inserted into a nozzle 50, 41 a rod, 42 a movable plunger, 45 a pressure piston, 46 a piezoelectric element, and 48 a needle pressure chamber. A compression spring 43 is arranged in a spring space 44 and urges the needle 40 downward. A pressure chamber 47 is defined by the top of the movable plunger 42 and the bottom of the pressure piston 45, and is filled with fuel. The needle pressure chamber 48 is connected to the reservoir tank 7 (FIG. 1) via a fuel passage 49 and the fuel supply pipe 15 (FIG. 1), and accordingly, high pressure fuel in the reservoir tank 7 is supplied to the fuel chamber 48 via the fuel supply pipe 15 and the fuel passage 49. When a charge is given to the piezoelectric element 46 to stop the fuel injection, the piezoelectric element 46 expands axially, and as result, the pressure piston 45 is moved downward in FIG. 2, and thus the fuel pressure in the pressure chamber 47 is rapidly increased. When the fuel pressure in the pressure chamber 47 is increased, the movable plunger 42 is moved downward in FIG. 2, and therefore, the needle is also moved downward and closes a nozzle opening 53.

On the other hand, when the charge of the piezoelectric element 46 is discharged to start the fuel injection, the piezoelectric element 46 is contracted, and as a result, the pressure piston 45 is moved upward in FIG. 2, and thus the fuel pressure in the pressure chamber 47 is reduced. When the fuel pressure in the pressure chamber 47 is reduced, the movable plunger 42 is moved upward in FIG. 2, and therefore, the needle is also moved upward and opens the nozzle opening 53.

Figure 3:
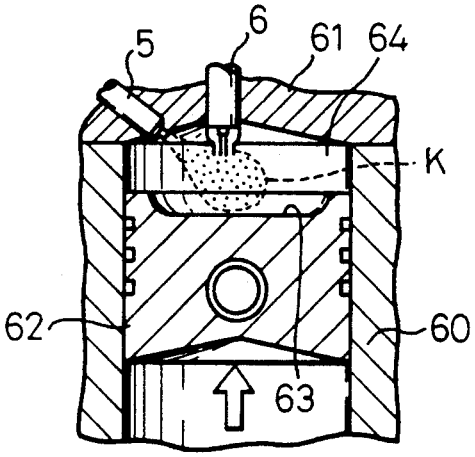
FIG. 3 is a cross-sectional side view of an engine to which an embodiment of the present invention is applied.

FIG. 3 illustrates an engine to which an embodiment of the present invention is applied. Referring to FIG. 3, reference numeral 60 designates a cylinder block, 61 a cylinder head, and 62 a piston. A cylindrical cavity 63 is formed at the center of the top of the piston 62, and a cylinder chamber 64 is defined between the top of the piston 62 and the bottom of the cylinder head 61. The spark plug 6 is arranged at approximately the center of the cylinder head 61. Although not shown in the drawing, an intake port and exhaust port are formed in the cylinder head 61, and an intake valve and an exhaust valve are arranged respectively at each opening of the intake port and the exhaust port to the cylinder chamber 64. The fuel injector 5 is a swirl type injector, and therefore, an atomized fuel injected from the fuel injector 5 has a wide spread angle and the speed of the injected fuel, which is along the direction of the injection, is relatively slow. The fuel injector 5 is arranged at the top of the cylinder chamber 64, inclined downwardly, so as to inject fuel to the vicinity of the spark plug 6. Furthermore, the direction of the fuel injection and the fuel injection timing of the fuel injector 5 are determined such that the fuel injected from the fuel injector 5 is directed to the cavity 63 formed at the top of the piston 62. An arrow shows a direction of movement of the piston 62.

Figure 4:
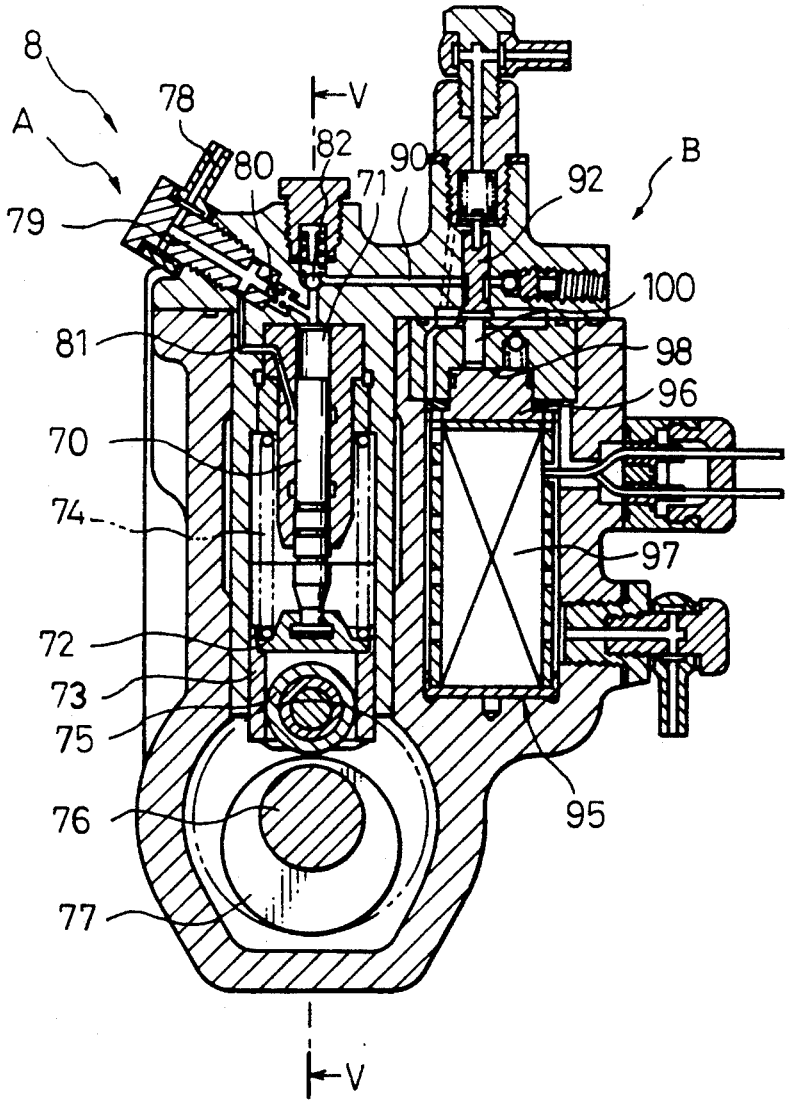
FIG. 4 is a cross-sectional side view of a high pressure fuel pump.
Figure 5:
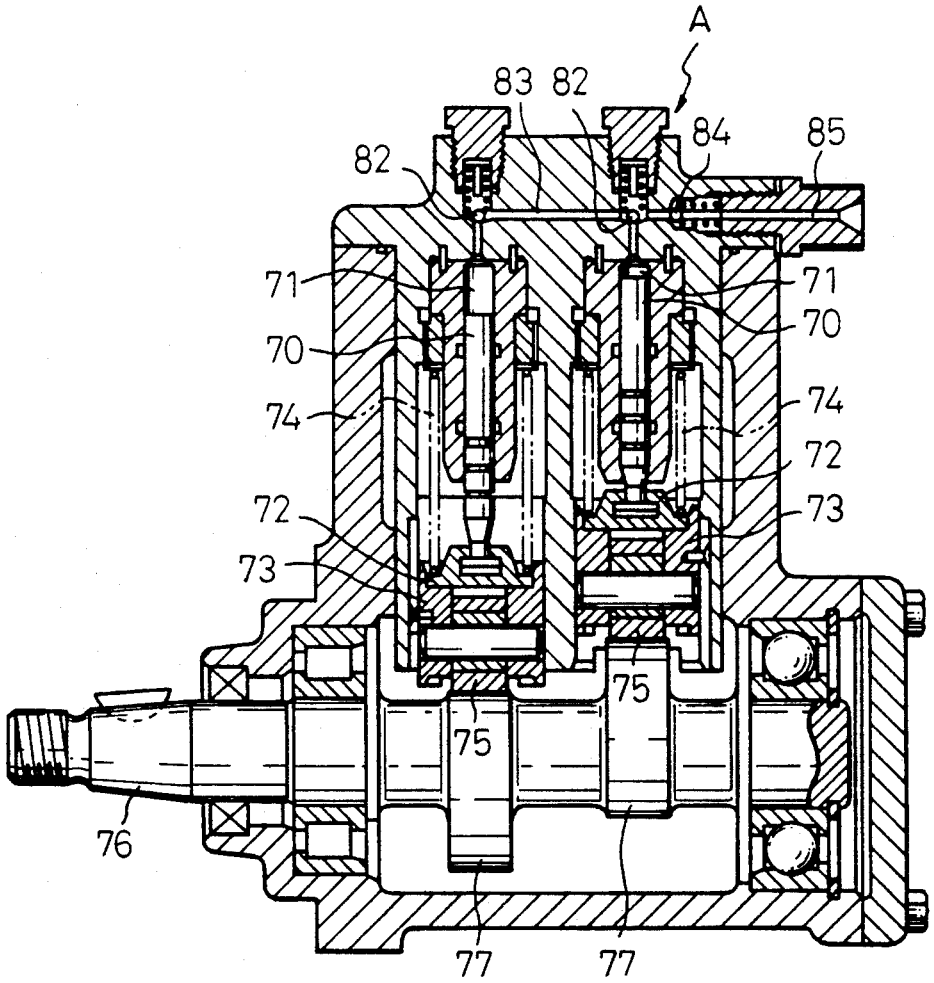
FIG. 5 is a cross-sectional view of a pump part, taken along the line V—V in FIG. 4.
Figure 6:
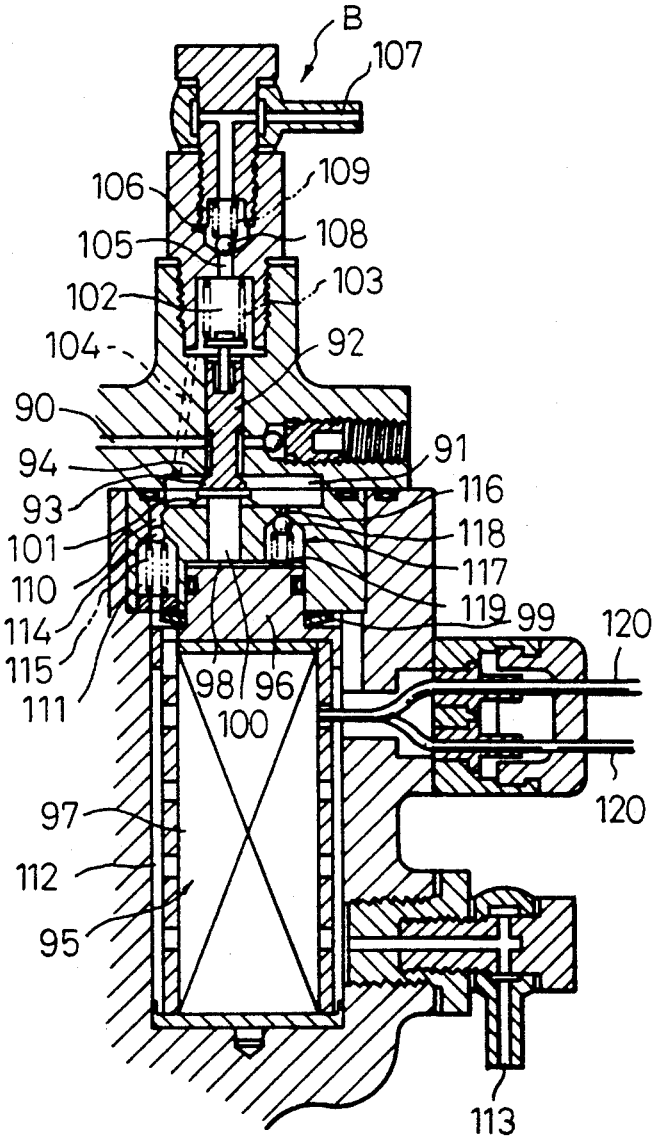
FIG. 6 is an enlarged cross-sectional side view of a discharge amount control part.

FIG. 4 is a cross-sectional side view of the high pressure fuel pump 8. If this high pressure fuel pump 8 is roughly divided into two parts, it comprises a pump part A and a discharge amount control part B for controlling the amount of fuel discharged from the pump part A. FIG. 5 is a cross-sectional view of the pump part A, and FIG. 6 is an enlarged cross-sectional side view of the discharge amount control part B. First, the construction of the pump part A will be described with reference to FIGS. 4 and 5, and thereafter, the construction of the discharge amount control part B will be described with reference to FIG. 6.

Referring to FIGS. 4 and 5, reference numeral 70 designates a pair of plungers, 71 pressure chambers defined by the corresponding plungers 70, and 73 tappets; 74 designates compression spring for biasing the plates 73 toward the corresponding tappets 73, 76 a camshaft driven by the engine, and 77 a pair of cams integrally formed on the camshaft 76. The rollers 75 rotate on the cam surface of the corresponding cams 77, and when the camshaft 76 is rotated, the plungers 70 move up and down.

Referring to FIG. 4, a fuel inlet 78 is formed on the top portion of the pump part A and connected to the discharge port of the low pressure fuel pump 11 (FIG. 1). This fuel inlet 78 is connected to the pressure chambers 7 via a fuel feed passage 79 and a check valve 80 so that, when the plungers 70 move downward, fuel is fed into the pressure chambers 71 from the fuel feed passage 79. In FIG. 4, reference numeral 81 designates a fuel return passage for returning fuel, which has leaked from the clearances around the plungers 70, to the fuel feed passage 79.

As illustrated in FIG. 4 and 5, the pressure chambers 71 is connected, via corresponding check valves 82, to a pressurized fuel passage 83 which is common to both the pressure chambers 71. This pressurized fuel passage 83 is connected to a pressurized fuel discharge port 85 via a check valve 84, and this pressurized fuel discharge port 85 is connected to the reservoir tank 7 (FIG. 1). Consequently, when the plungers 70 move upward, and thus the pressure of fuel in the pressure chambers 71 is increased, the fuel under high pressure in the pressure chambers 71 is discharged into the pressurized fuel passage 83 via the check valves 84 and then fed into the reservoir tank 7 (FIG. 1) via the check valve 84 and the fuel discharge port 85. The cam phase of one of the cams 77 is deviated from the cam phase of the other cam 77 by 180 degrees, and therefore, when one of the plungers 70 is moving upward to discharge fuel under a high pressure, the other plunger 70 is moving downward to suck in fuel. Consequently, fuel under a high pressure is fed into the pressurized fuel passage 83 from either one of the pressure chambers 71. Namely, fuel under a high pressure is continuously fed into the pressurized fuel passage 83 by the plungers 70. As illustrated in FIG. 4, a fuel spill passage 90 is branched from the pressurized fuel passage 83 and connected to the discharge amount control part B.

Referring to FIG. 6, the discharge amount control part B comprises a fuel spill chamber 91 formed in the housing thereof, and a spill control valve 92 for controlling the fuel flow from the fuel spill passage 90 toward the fuel spill chamber 91. The spill control valve 92 has a valve head 93 positioned in the fuel spill chamber 91, and the opening and closing of a valve port 94 is controlled by the valve head 93. In addition, an actuator 95 for actuating the spill control valve 92 is arranged in the housing of the discharge amount control part B. This actuator 95 comprises a pressure piston 96 slidably inserted into the housing of the discharge amount control part B, a piezoelectric element 97 for driving the pressure piston 96, a pressure chamber 98 defined by the pressure piston 96, a flat spring 99 for biasing the pressure piston 96 toward the piezoelectric element 97, and a pressure pin 100 slidably inserted into the housing of the discharge amount control part B. The upper end face of the pressure pin 100 abuts against the valve head 93 of the spill control valve 92, and the lower end face of the pressure pin 100 is exposed to the pressure chamber 98. A flat spring 101 is arranged in the fuel spill chamber 91 to continuously bias the pressure pin 100 upward, and a spring chamber 102 is formed above the spill control valve 92 and a compression spring 103 is arranged in the spring chamber 102. The spill control valve 92 is continuously urged downward by the compression spring 103. The fuel spill chamber 91 is connected to the spring chamber 102 via a fuel outflow bore 104, and the spring chamber 102 is connected to the fuel tank 7 (FIG. 1) via a fuel outflow bore 105, a check valve 106, and a fuel outlet 107. The check valve 106 comprises a check ball 108 normally closing the fuel outflow bore 105, and a compression spring 109 for urging the check ball 108 toward the fuel outflow bore 105. In addition, the fuel spill chamber 91 is connected to the fuel tank 7 (FIG. 1) via a fuel outflow bore 110, a check valve 111, a fuel outflow passage 112 formed around the piezoelectric element 97, and a fuel outlet 113. The check valve 111 comprises a check ball 114 normally closing the fuel outflow bore 110, and a compression spring 115 for biasing the check ball 114 toward the fuel outflow bore 110. Furthermore, the fuel spill chamber 91 is connected to the pressure chamber 98 via a flow area restricted passage 116 and a check valve 117. The check valve 117 comprises a check ball 118 normally closing the flow area restricted passage 116, and a compression spring 119 for biasing the check ball 118 toward the flow area restricted passage 116. The flow area restricted passage 116 has a cross-sectional area which is smaller than that of the fuel outflow bore 110. In addition, the valve opening pressures of a pair of the check valves 116 and are made the same, and the valve opening pressure of the check valve 117 is made lower than the valve opening pressures of the check valves 106 and 111. That is, the compression springs 109 and 115 of the check valves 106 and 111 have almost the same spring force, and the spring force of the compression spring 119 of the check valve 117 is made weaker that of the compression springs 109 and 115.

The piezoelectric element 97 is connected to the electronic control unit 20 (FIG. 1) via lead wires 120 and controlled on the basis of a signal output from the electronic control unit 20. The piezoelectric element 97 has a stacked construction obtained by stacking a plurality of piezoelectric thin plates. This piezoelectric element 97 is axially expanded when charged with electrons, and is axially contracted when the electrons are discharged therefrom. Both the fuel spill chamber 91 and the pressure chamber 98 are filled with fuel, and therefore, when the piezoelectric element 97 is charged with electrons, and thus is axially expanded, the pressure of fuel in the pressure chamber 98 is increased. If the pressure of fuel in the pressure chamber 98 is increased, the pressure pin 100 is moved upward, and accordingly, the spill control valve 96 is moved upward. As a result, the valve head 93 of the spill control valve 92 closes the valve port 94, and thus the spill of fuel from the fuel spill passage 90 into the fuel spill chamber 91 is stopped. Consequently, at this time, the entire fuel discharged into the pressurized fuel passage 83 (FIG. 5) from the pressure chambers 71 of the plungers 70 is fed into the reservoir tank 7 (FIG. 1).

Conversely, when electrons are discharged from the piezoelectric element 97, and thus the piezoelectric element 97 is contracted, since the pressure piston 96 moves downward, the volume of the pressure chamber 98 is increased. As a result, since the pressure of fuel in the pressure chamber 98 is lowered, both the spill control valve 92 and the pressure pin 100 are moved downward by the spring before of the compression spring 83, and thus the valve head 93 of the spill fuel valve 92 opens the valve port 94. At this time, the entire fuel discharged into the pressurized fuel passage 83 (FIG. 5) from the pressure chambers 71 of the plungers 70 is spilled into the fuel spill chamber 91 via the fuel spill passage 90 and the valve port 94. Consequently, at this time, fuel under a high pressure is not fed into the reservoir tank 7 (FIG. 1).

The fuel spilled into the fuel spill chamber 91 from the fuel spill passage 90 is returned to the fuel tank 10 (FIG. 1) via the fuel outflow bores 104, 105, 110 and the check valves 106, 111.

Figure 7:
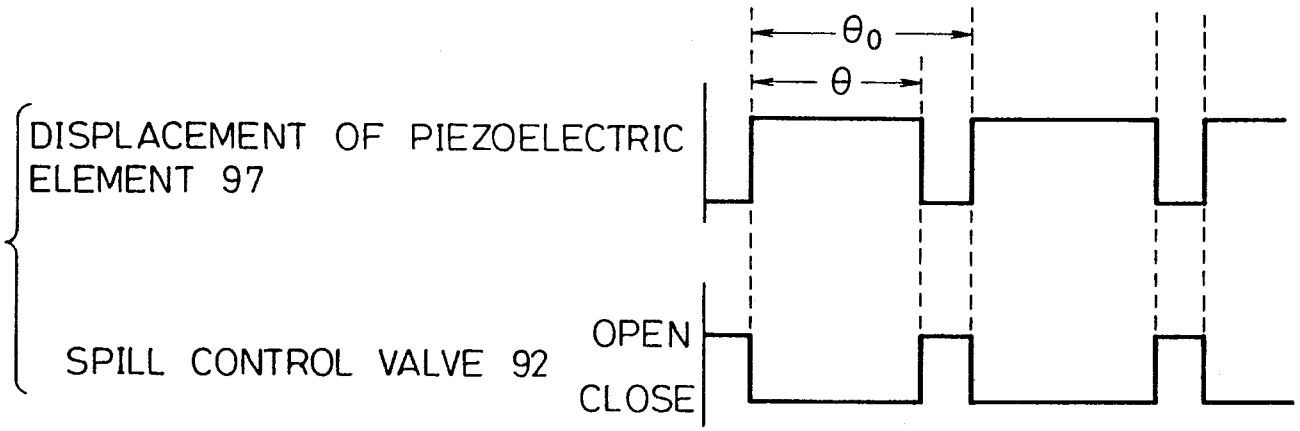
FIG. 7 is a time chart illustrating the operations of the piezoelectric element and the spill control valve.

The amount of fuel injected by the fuel injectors 5 is fixed by the fuel injection time and the pressure of fuel in the reservoir tank 7, and the pressure of fuel in the reservoir tank 7 is normally maintained at a predetermined target pressure. In addition, a necessary amount of fuel is fed into each cylinder during a 720 degrees of angle of rotation of the crankshaft, and therefore, the amount of fuel in the reservoir tank 7 is reduced each time the crankshaft is rotated by a fixed degree of angle of rotation. Consequently, to maintain the pressure of fuel in the reservoir tank 7 at a target pressure, preferably fuel under pressure is fed into the reservoir tank 7 each time the crankshaft is rotated by a fixed degree of angle of rotation of the crankshaft. Therefore, the spill control valve 92 is normally closed each time the crankshaft is rotated by a fixed angle of degree of the crankshaft rotation to feed fuel under pressure discharged from the pressure chambers 71 of the plungers 70 into the reservoir tank 7, and the spill control valve 92 remains open until closed again. In this case, the amount of fuel under pressure fed into the reservoir tank 7 is increased as the angle of the degree of rotation of the crankshaft during which the spill control valve 92 remains closed while the above-mentioned fixed degree of the angle of rotation of the crankshaft is increased. That is, as illustrated in FIG. 7, if an angle of degree $\theta$ of the crankshaft rotation during which the spill control valve 97 remains closed for the fixed angle of degree $\theta_0$ of the crankshaft rotation, i.e., an angle of degree $\theta$ of the crankshaft rotation during which the piezoelectric element 97 is expanded for the fixed angle of degree $\theta_0$ of the crankshaft rotation is called the duty ratio DT ($=\theta/\theta_0$), and the amount of fuel under pressure fed into the reservoir tank 7 is increased as the duty ratio DT becomes larger.

Figure 8:
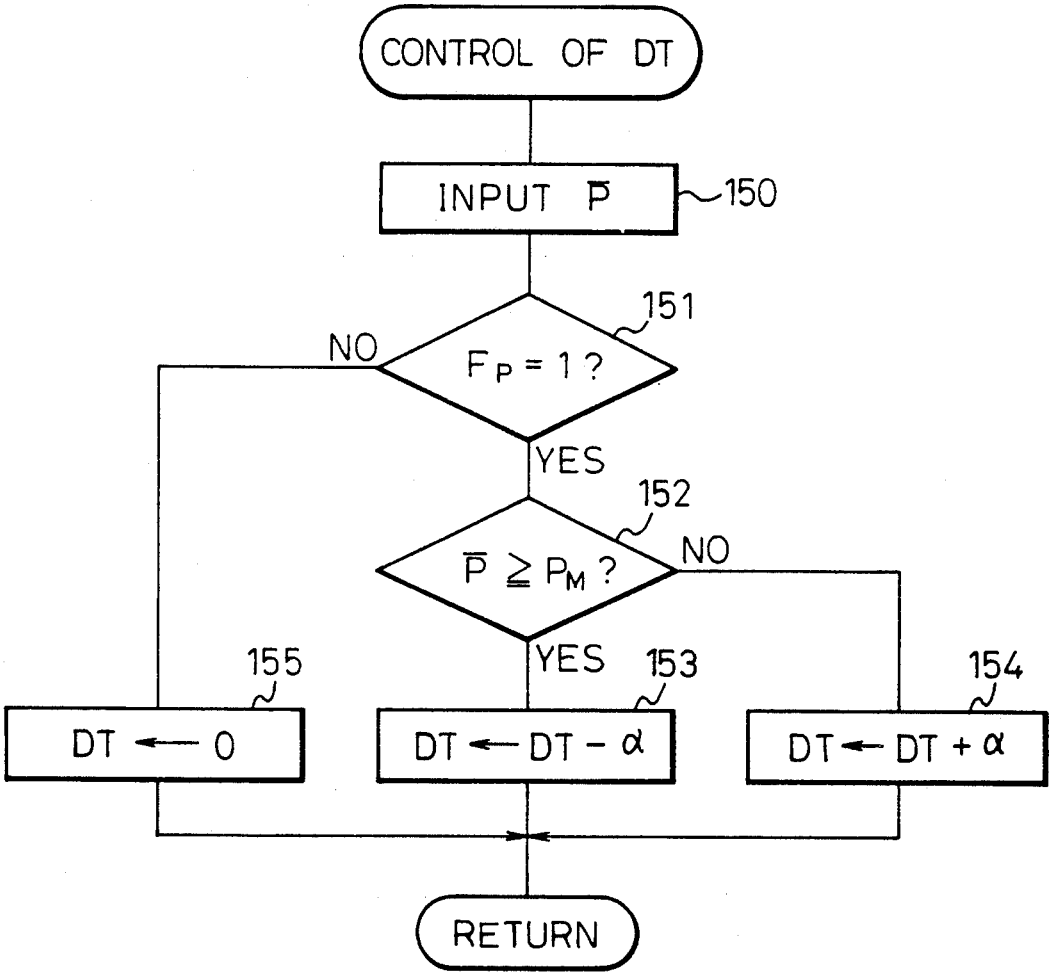
FIG. 8 is a flow chart for controlling the fuel pressure in the reservoir tank.

FIG. 8 illustrates a routine for controlling the pressure of fuel in the reservoir tank 7, which routine is processed by sequential interruptions executed at predetermined crank angles.

Referring to FIG. 8, at step 150, the average fuel pressure $\overline{P}$ in the reservoir tank 7 is input to the CPU 24. The average fuel pressure $\overline{P}$ is an average of a plurality of the fuel pressures $P_r$ in the reservoir tank 7 detected at predetermined intervals. At step 151, it is determined whether or not a pump flag $F_p$, described hereinafter, is set to 1. Since $F_p$ is normally set to 1, the routine usually then goes to step 152. At step 152, it is determined whether or not the average pressure $\overline{P}$ is equal to or more than a predetermined target pressure $P_M$. When $\overline{P} \geqq P_M$, the routine goes to step 153 and a predetermined constant value $\alpha$ is subtracted from the duty ratio DT, whereby the amount of fuel under pressure fed into the reservoir tank 7 is reduced. When $\overline{P} < P_M$, the routine goes to step 154 and the predetermined constant value $\alpha$ is added to the duty ratio DT, whereby the amount of fuel under pressure fed into the reservoir tank 7 is increased.

Conversely, at step 151, when $F_p$ is reset, the routine goes to step 155 and the duty ratio DT is made 0, and therefore, no fuel under pressure is fed into the reservoir tank 7.

Figure 9:
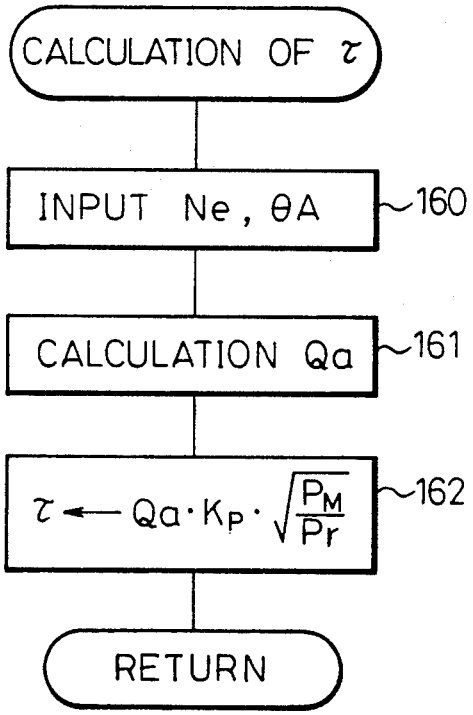
FIG. 9 is a flow chart for calculating a fuel injection time $\tau$ according to the first embodiment of the present invention.

FIG. 9 illustrates a routine for calculating a fuel injection time $\tau$ according to the first embodiment of the present invention, and this routine is processed by sequential interruptions executed at predetermined crank angles.

Referring to FIG. 9, at step 160, an engine speed $N_e$ and a degree $\theta A$ of opening of the accelerator pedal 32 are input to the CPU 24, and at step 161, a basic amount $Q_a$ of fuel to be injected is calculated from the engine speed Ne and the degree $\theta A$ of opening of the accelerator pedal 32. The basic amount $Q_a$ of fuel to be injected is stored in the ROM 22 in the form of a map, on the basis of Ne and $\theta A$, and at step 162, the fuel injection time $\tau$ is calculated from the following equation.

$$\tau = Q_a \cdot K_p \cdot (P_M/P_r)^{\frac{1}{2}}$$

Where $K_p$ is an average correction coefficient for converting the amount of fuel to be injected at the time of a fuel injection to make a total actual amount $Q_p$ (see step 180 in FIG. 11B) of fuel to be injected identical to a cumulative calculated target amount $Q_c$ (see step 193 in FIG. 12) of fuel to be injected.

Figure 10:
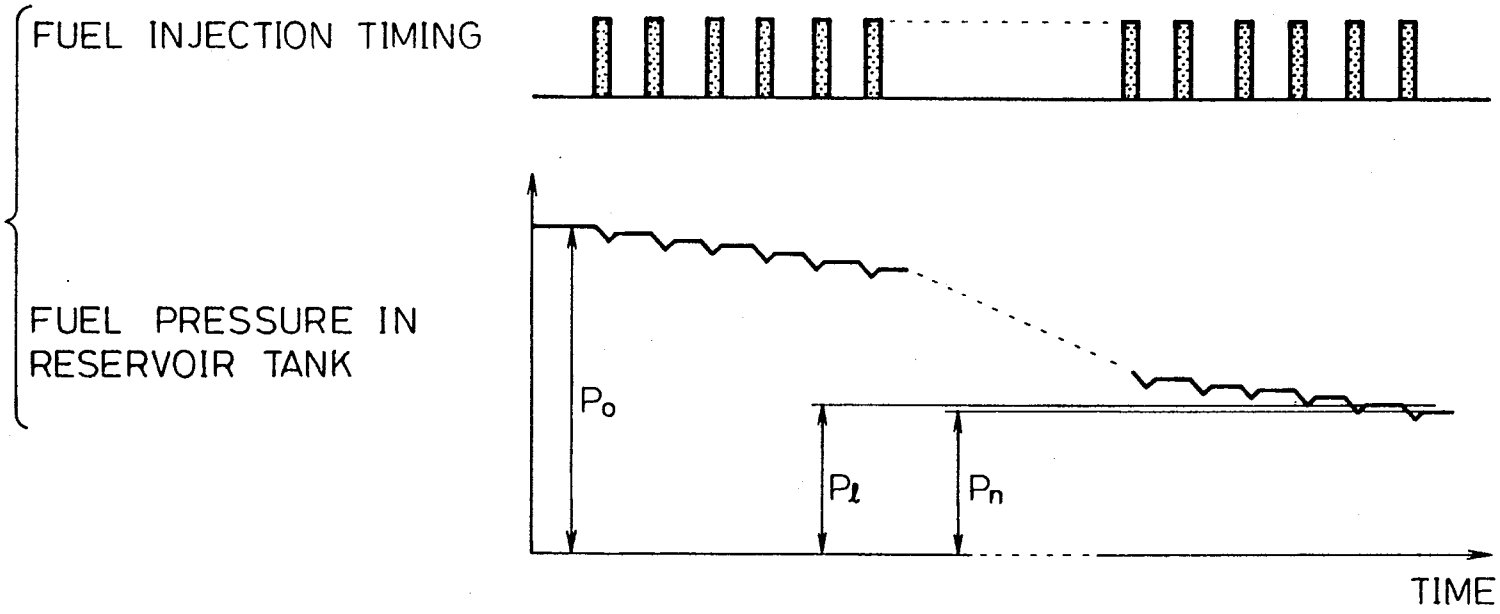
FIG. 10 is a time chart illustrating a fuel injection timing of fuel injectors and the change of fuel pressure in the reservoir tank when $K_p$ is calculated.

FIG. 10 illustrates a fuel injection timing of the fuel injectors 5, and the pressure change of fuel in the reservoir tank 7 when the average correction coefficient $K_p$ is calculated.

Figures 11, 11A:
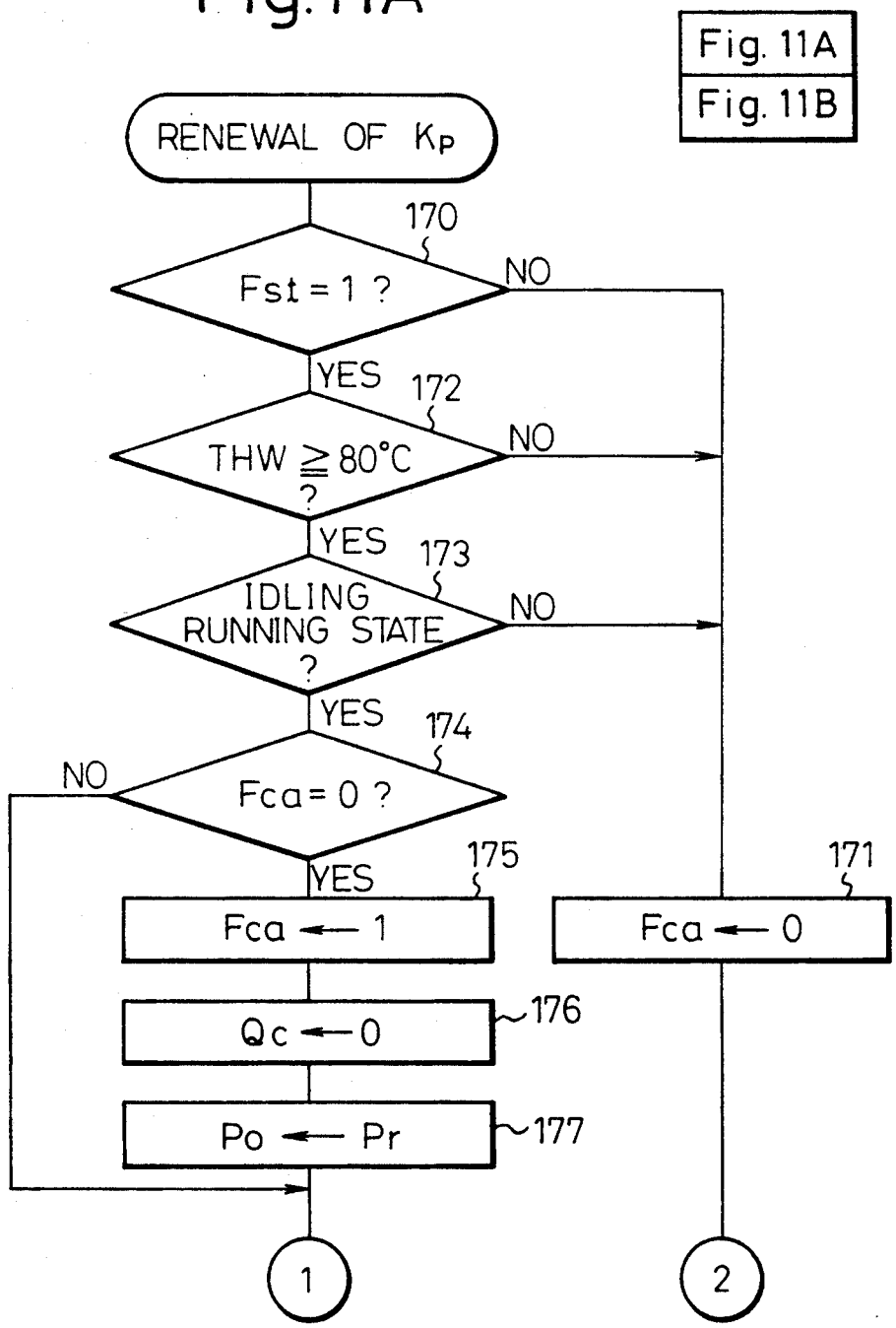
FIGS. 11, 11A and 11B are flow charts for renewing an average correction coefficient $K_p$.
Figure 11B:
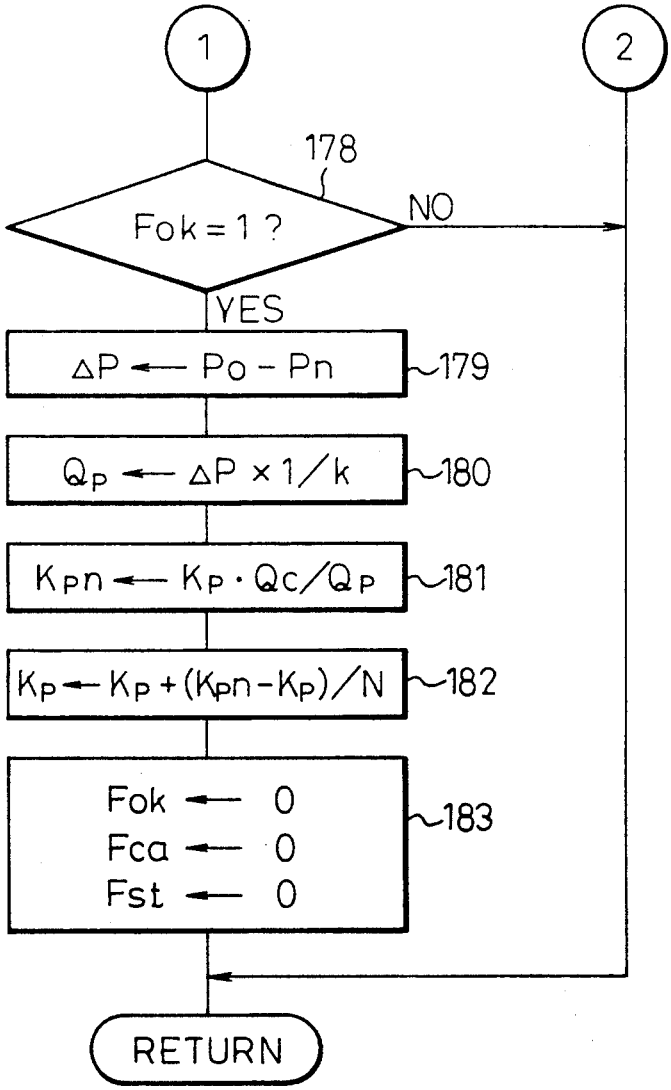

FIGS. 11A and 11B illustrate a routine for renewing $K_p$ according to the first embodiment of the present invention. This routine is processed by sequential interruptions executed at predetermined intervals. $K_p$ is renewed only once when the electronic control unit is turned ON, and the renewed $K_p$ is stored in the backup RAM 23*a*.

Referring to FIGS. 11A and 11B, at step 170, it is determined whether or not a start flag $F_{st}$ is set. The start flag $F_{st}$ is set to 1 when the engine is started. When $F_{st}$ is reset, the routine goes to step 171, a measure flag $F_{cs}$ is reset, and then this routine is completed. When $F_{st}$ is set to 1, the routine goes to step 172, and it is determined whether or not an engine coolant temperature THW is equal to or higher than 80° C. When THW $<$80° C., the routine goes to step 171 and then the routine is completed. When THW $\geqq$80°, the routine goes to step 173 and it is determined whether or not an engine running state is an idling engine running state. When the engine running state is not the idling engine running state, the routine goes to step 171, and then the routine is completed. When the engine running state is the idling engine running state, the routine goes to step 174 and it is determined whether or not the measure flag $F_{ca}$ is reset. Initially, since $F_{ca}$ is reset, the routine goes to step 175 and $F_{ca}$ is set to 1. Then, at step 176, the cumulative calculated target amount $Q_c$ of fuel to be injected is made 0, and at step 177, the fuel pressure $P_r$ in the reservoir tank 7 is stored as an initial fuel pressure $P_o$ (see FIG. 10). In the next processing cycle, since the measure flag $F_{ca}$ is set to 1, steps 175 through 177 are skipped.

At step 178, it is determined whether or not a completion flag $F_{ok}$ is set to 1. When $F_{ok}$ is set to 1, the routine goes to steps 179 through 183 and $K_p$ is renewed.

Figure 12:
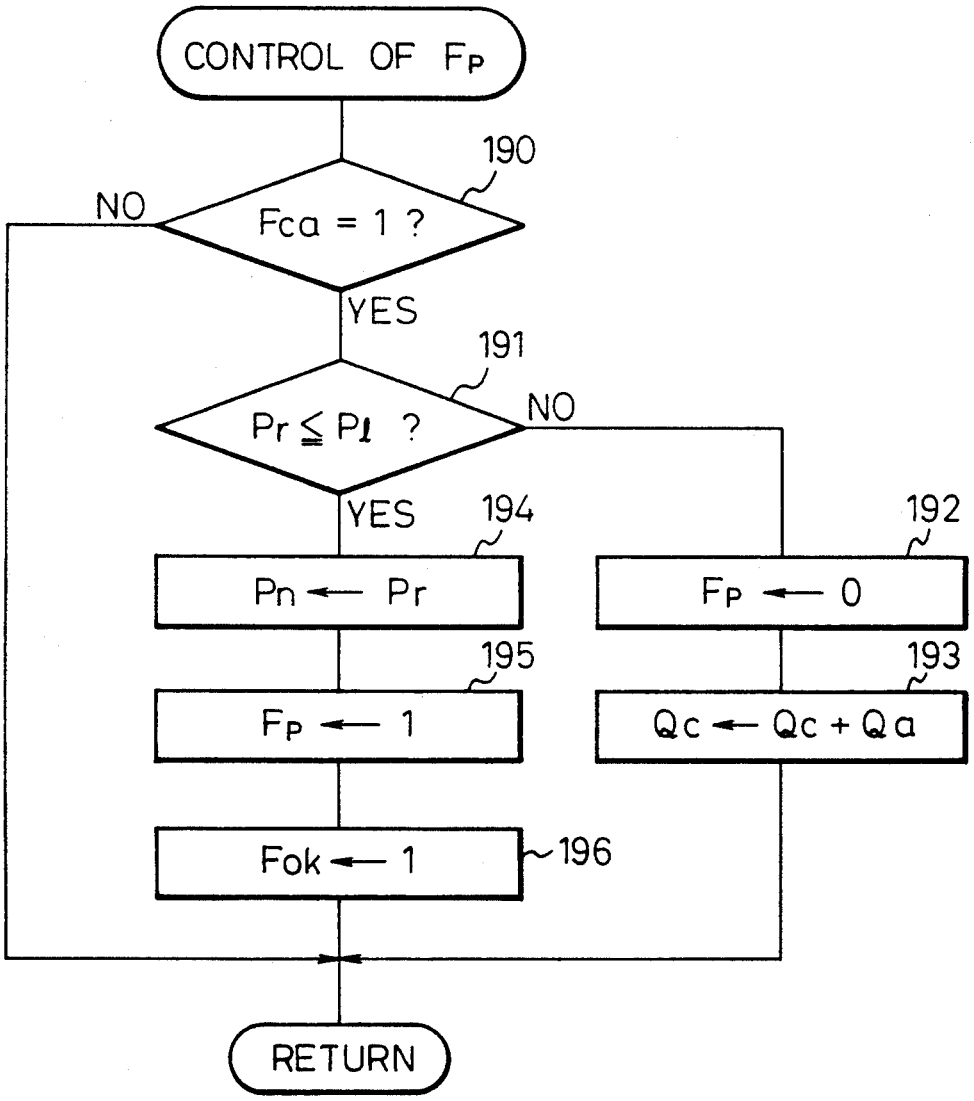
FIG. 12 is a flow chart for controlling a pump flag $F_p$.

FIG. 12 illustrates a routine for controlling the pump flag $F_p$. This routine is processed by sequential interruptions executed at 180 CA.

Referring to FIG. 12, it is determined whether or not the measure flag $F_{ca}$ is set to 1. When $F_{ca}$ is reset, this routine is completed. When $F_{ca}$ is set to 1, the routine goes to step 191 and it is determined whether or not the fuel pressure $P_r$ in the reservoir tank 7 is lower than or equal to a minimum fuel pressure $P_l$ (see FIG. 10). Although the minimum fuel pressure $P_l$ is low enough, compared with the target fuel pressure $P_M$ (see step 152 in FIG. 8) in the reservoir tank 7, $P_l$ is high enough to inject fuel. Since the fuel pressure in the reservoir tank 7 is controlled to the target fuel pressure $P_M$, it is determined that $P_r$ is higher than $P_l$ at step 191 and the routine goes to step 192. At step 192, the pump flag $F_p$ is reset. Accordingly, since it is determined that $F_p$ is reset at step 151 in FIG. 8, the duty ratio DT is made 0 at step 155 in FIG. 8, the duty ratio DT is made 0 at step 155 in FIG. 8, and therefore, a supply of pressurized fuel to the reservoir tank 7 is prohibited. As a result, as shown in FIG. 10, the fuel pressure in the reservoir tank 7 is lowered upon each fuel injection. The initial fuel pressure $P_o$ indicates a fuel pressure immediately before a first fuel injection, while pressurized fuel is not fed into the reservoir tank 7.

Returning to FIG. 12, at step 193, the cumulation calculated target amount $Q_c$ of fuel to be injected is accumulated by the basic amount $Q_a$ of fuel to be injected at each fuel injection.

Conversely, when $P_r \leqq P_l$ at step 191, the routine goes to step 194 and the fuel pressure $P_r$ in the reservoir tank 7 is stored as a final fuel pressure. Then, at step 195, the pump flag $F_p$ is set to 1. Accordingly, since it is determined that $F_p$ is set at step 151 in FIG. 8, the duty ratio DT is controlled to make the fuel pressure in the reservoir tank 7 identical to the target fuel pressure $P_M$, and at step 196 in FIG. 12, the completion flag $F_{ok}$ is set.

As mentioned above, in the routine of FIG. 12, when the measure flag $F_{ca}$ is set, the fuel supply to the reservoir tank 7 is stopped and the fuel pressure $P_r$ at this time in the reservoir tank 7 is stored as the initial fuel pressure $P_o$, the basic amount $Q_a$ of fuel to be injected is accumulated at each fuel injection until the fuel pressure $P_r$ becomes lower than the minimum fuel pressure $P_l$, the fuel pressure $P_r$ when the fuel pressure $P_r$ becomes lower than the minimum fuel pressure $P_l$ is stored as the final fuel pressure $P_n$, the fuel supply to the reservoir tank 7 is started, and the completion flag $F_{ok}$ is set when the fuel pressure $P_r$ becomes lower than the minimum fuel pressure $P_l$.

Returning to FIG. 11, when the measuring of $Q_c$ and $P_n$ is completed in the routine of FIG. 12, it is determined that $F_{ok}$ is set and the routine goes to step 179. At step 179, an amount of fuel pressure drop $\Delta P$ is calculated from the following equation.

$$\Delta P = P_o - P_n$$

At step 180, the total actual amount $Q_p$ of fuel to be injected is calculated from the following equation, on the basis of $\Delta P$.

$$Q_p = \Delta P / K$$

Where K is a predetermined constant coefficient for converting the amount of fuel pressure drop to the amount of fuel to be injected. At step 181, a provisional average correction coefficient $K_{pn}$ is calculated from the following equation.

$$K_{pn} = K_p \cdot Q_c / Q_p$$

Where, for example, if the cumulation calculated target amount $Q_c$ of fuel to be injected is equal to 100 and the total actual amount $Q_p$ of fuel to be injected is equal to 95, $K_{pn}$ is equal to $K_p \cdot 100/95$, and accordingly, the provisional average correction coefficient $K_{pn}$ is increased. $K_p$ is calculated as described below, and accordingly, $K_p$ is increased as $K_{pn}$ is increased. Therefore, since the fuel injection time, i.e., an actual amount of fuel to be injected, is increased (see step 162 in FIG. 9), $Q_p$ can be made equal to $Q_c$.

At step 182, the average correction coefficient $K_p$ is renewed from the following expression.

$$K_p + (K_{pn} - K_p)/N$$

This expression can be rewritten by the following expression.

$$\{(N-1) \cdot K_p + K_{pn}\}/N$$

As known from this expression, $K_p$ is weighted by $(N-1)$ and $K_{pn}$ is weighted by 1. Then, at step 183, the completion flag $F_{ok}$, the measure flag $F_{ca}$, and the start flag $F_{st}$ are cleared.

As mentioned above, according to the first embodiment of the present invention, since the amount of fuel pressure drop caused by a plurality of fuel injections is detected while the fuel supply to the reservoir tank 7 is stopped, the amount of fuel pressure drop is precisely detected. Therefore, the actual total amount of fuel to be injected can be precisely determined, and thus the actual total amount of fuel to be injected can be made identical to the total of the target amount of fuel to be injected.

A second embodiment of the present invention is now described with reference to FIGS. 13 through 16, and is applied to an engine similar to that illustrated in FIG. 1.

Figure 13:
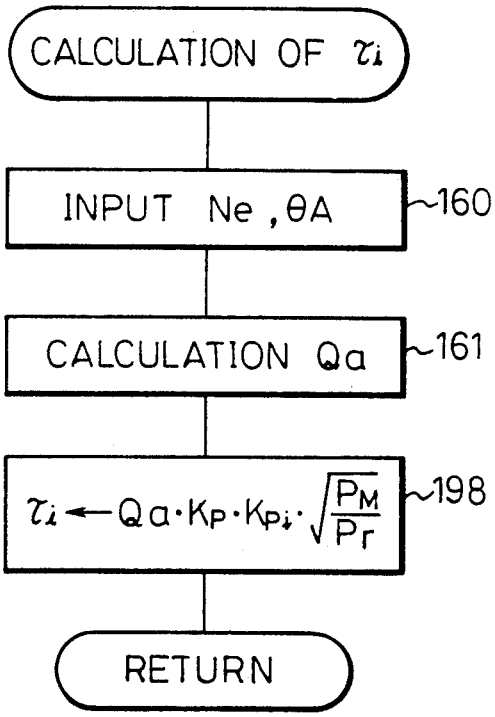
FIG. 13 is a flow chart for calculating a fuel injection time $\tau_i$ of each fuel injector according to the second embodiment of the present invention.

FIG. 13 illustrates a routine for calculating each fuel injection time $\tau_i$ corresponding to each fuel injector 5. This routine is processed by sequential interruptions executed at predetermined crank angles. In FIG. 13, the same steps are indicated by the same step numbers used in FIG. 9, and thus descriptions thereof are omitted.

At step 198, each fuel injection time $\tau_i$ corresponding to each fuel injector 5 of each cylinder is calculated from the following equation.

$$\tau_i = Q_a \cdot K_p \cdot K_{pi} \cdot \sqrt{\frac{P_M}{P_r}}$$

Where $K_{pi}$ is a correction coefficient of each fuel injector. In this embodiment, since the engine has four fuel injectors corresponding to four cylinders, i is changed from 1 to 4.

Figure 14:
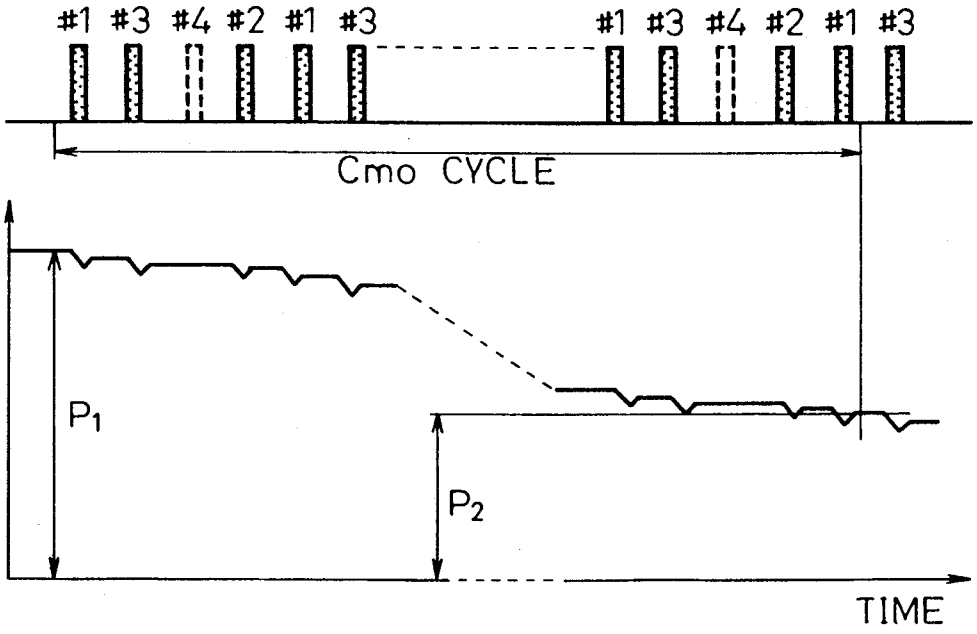
FIG. 14 is a time chart illustrating a fuel injection timing and the change of fuel pressure in the reservoir tank when $K_{pi}$ is renewed according to the second embodiment of the present invention.

FIG. 14 illustrates a fuel injection timing of the fuel injectors 5 and the pressure change in the fuel in the reservoir tank 7 when $K_{pi}$ is renewed according to the second embodiment of the present invention. In this embodiment, $K_{pi}$ is renewed by stopping the fuel supply to the reservoir tank 7 and prohibiting the fuel injection by one of the four fuel injectors 5. $K_{p1}$, $K_{p2}$, $K_{p3}$ and $K_{p4}$ are renewed only once, respectively, after $K_p$ has been corrected, and the renewed $K_{pi}$ of each fuel injector is stored in the backup RAM 23a respectively.

Figures 15, 15A:
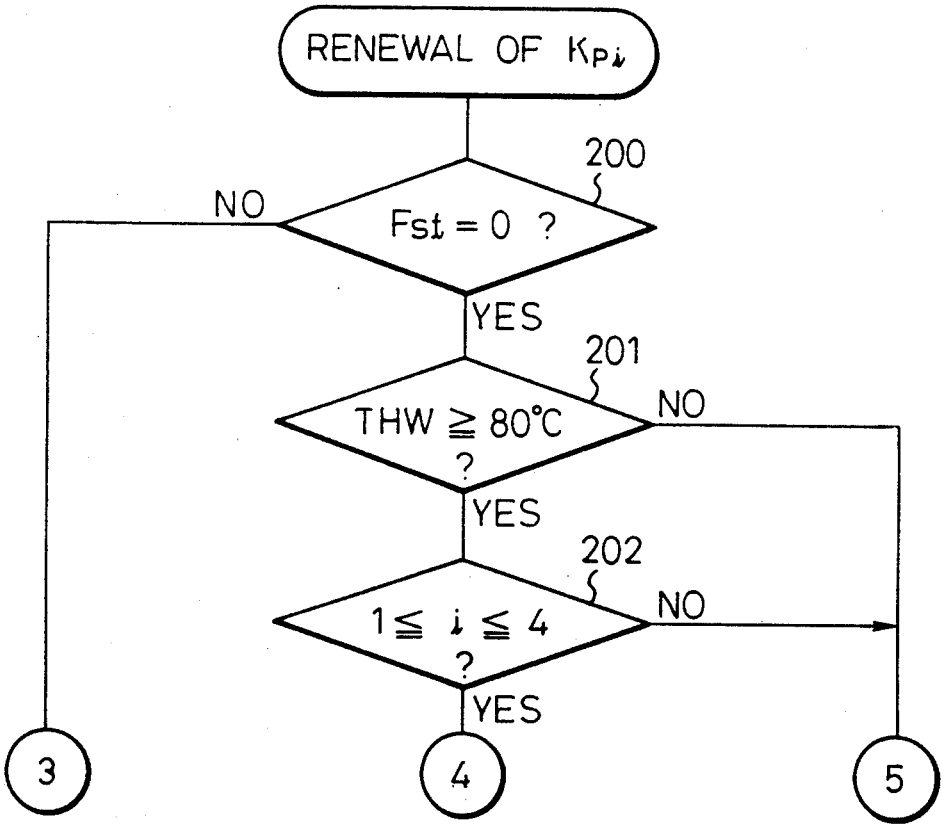
FIGS. 15, 15A, 15B, and 15C are flow charts for renewing a correction coefficient $K_{pi}$ of each fuel injector according to the second embodiment of the present invention.
Figure 15B:
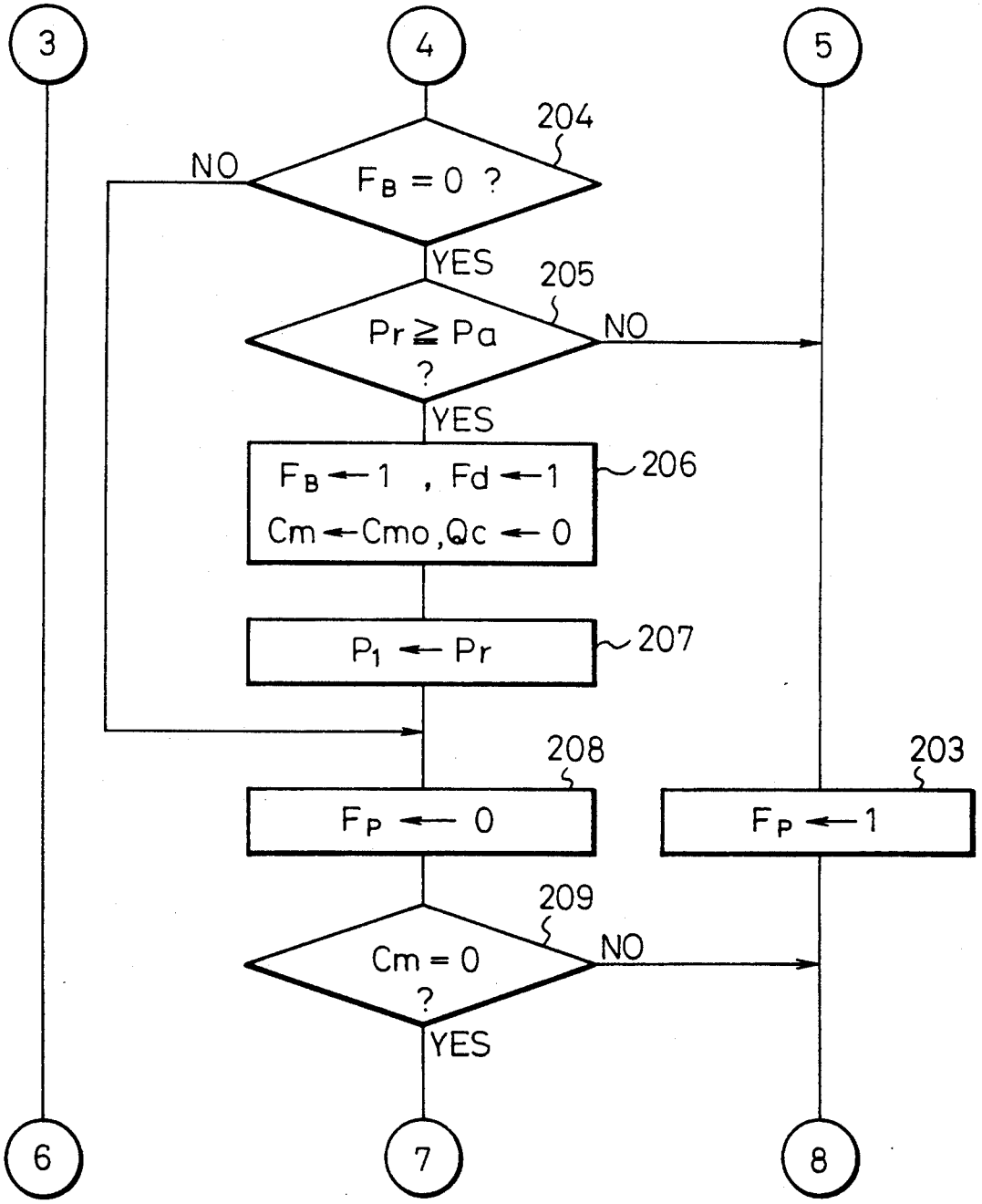
Figure 15C:
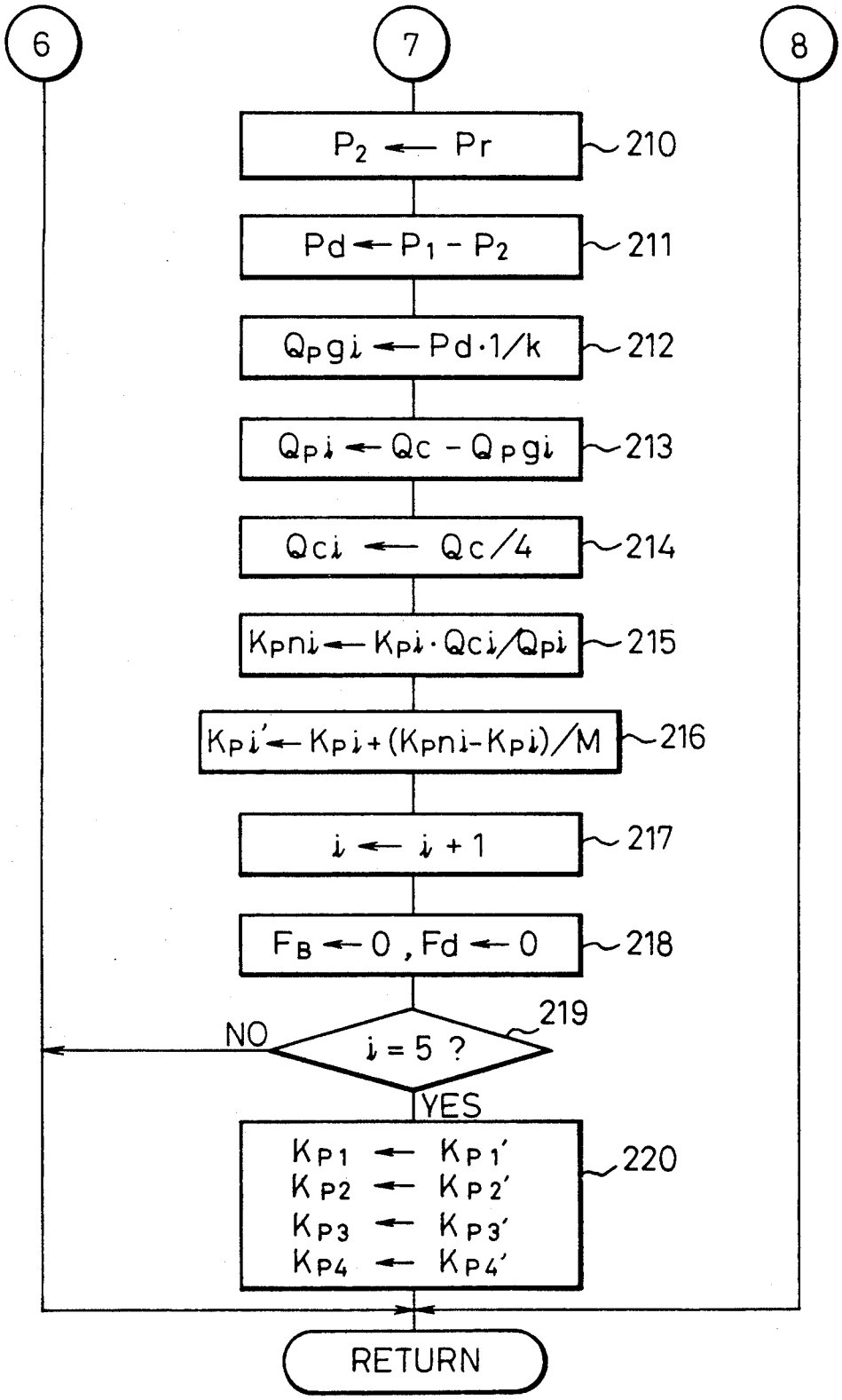

FIGS. 15A through 15C illustrate a routine for renewing $K_{pi}$. This routine is processed by sequential interruptions executed at predetermined intervals.

Referring to FIGS. 15A through 15C, at step 200, it is determined whether or not the start flag $F_{st}$ is reset. The start flag $F_{st}$ is set 1 when the engine is started, and reset after the average correction coefficient $K_p$ is renewed in the routine of FIGS. 11A and 11B. When $F_{st}$ is set, i.e., when $K_p$ has not been renewed, the routine is completed. When $F_{st}$ is reset, i.e., when $K_p$ has been renewed in the routine of FIGS. 11A and 11B, the routine goes to step 201 and it is determined whether or not the engine coolant temperature THW is equal to or higher than 80° C. Note, when $K_p$ has been renewed, the pump flag $F_p$ is set to 1, and accordingly, pressurized fuel is fed to the reservoir tank 7 and the fuel pressure in the reservoir tank 7 is raised until it reaches the target fuel pressure $P_M$. When THW $\geqq 80°$ C., the routine goes to step 202 and it is determined whether or not i is equal to or larger than 1, and smaller than or equal to 4. When the determination is negative at step 201 or step 202, the routine goes to step 203 and the pump flag $F_p$ is maintained or 1. Since i is equal to 1 first, the routine goes to step 204 and it is determined whether or not a renewal flag $F_B$ is reset. Since $F_B$ is reset first, the routine goes to step 205 and it is determined whether or not the fuel pressure $P_r$ in the reservoir tank 7 is equal to or higher than a predetermined standard pressure $P_a$, which is slightly lower than the target fuel pressure $P_M$.

When $P_r < P_a$ after the fuel pressure in the reservoir tank 7 is reduced for renewing $K_p$, the routine goes to step 203 and is completed. When $P_r \geqq P_a$, the routine goes to step 206. At step 206, the renewal flag $F_B$ is set, a measure flag $F_d$ is set, a counter $C_m$ is set to a predetermined value $C_{mo}$, and a total amount $Q_c$ of fuel to be injected is cleared. Where, $C_{mo}$ is a multiple of 4; for example, $C_{mo}$ is 12.

At step 207, the fuel pressure $P_r$ in the reservoir tank 7 at this time is stored as a measuring start fuel pressure $P_1$ (see FIG. 14). In the processing cycle after the next processing cycle, since the renewal flag $F_B$ is set, steps 205 through 207 are skipped. At step 208, since the pump flag $F_p$ is reset, the fuel supply to the reservoir tank 7 is stopped (see FIG. 8). At step 209, it is determined whether or not the counter $C_m$ is equal to 0. When $C_m$ is equal to 0, the routine goes to steps 210 through 220 and $K_{pi}$ is renewed. When $C_m$ is not equal to 0, the routine is completed.

Figure 16:
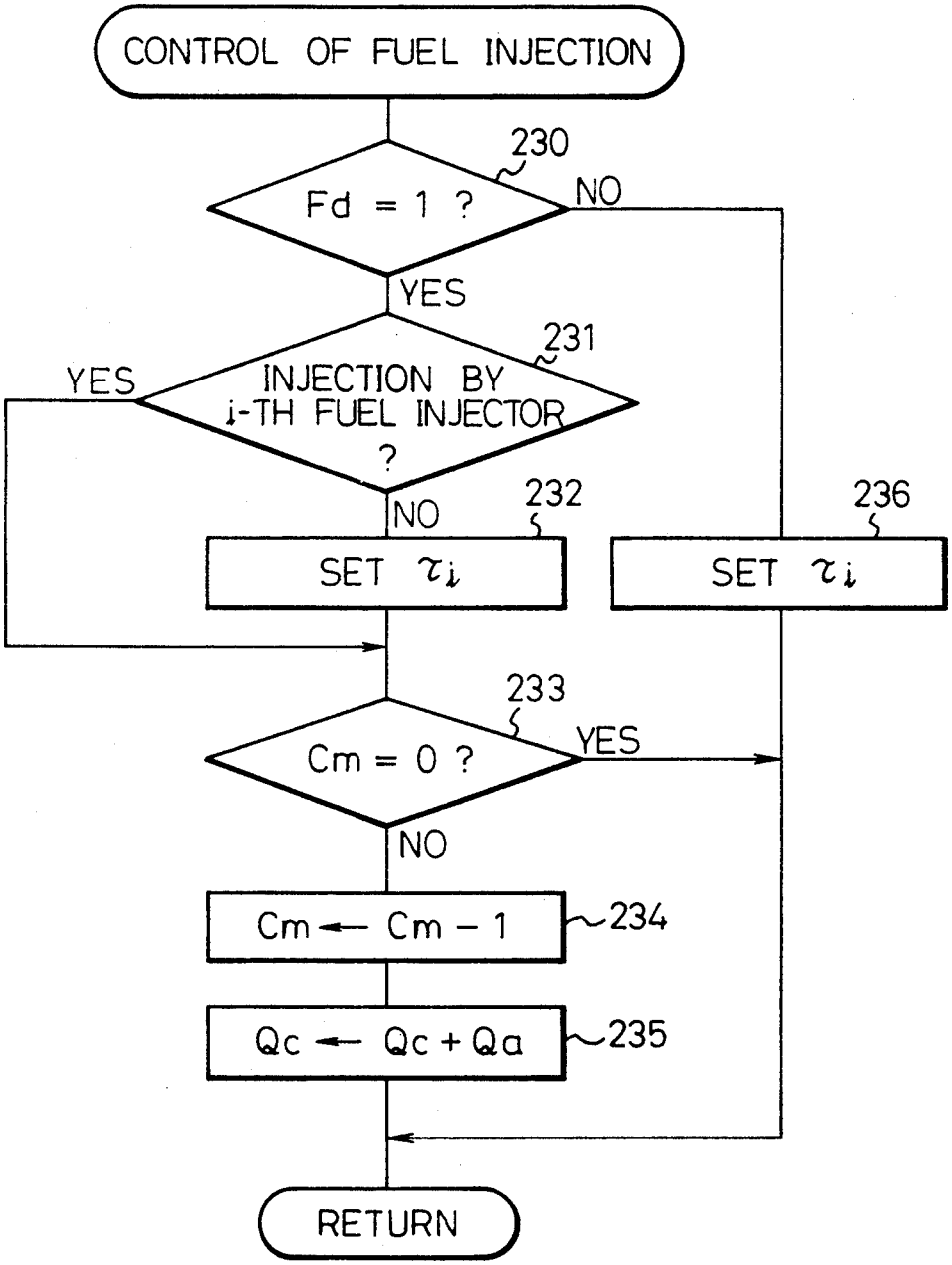
FIG. 16 is a flow chart for controlling the fuel injection according to the second embodiment of the present invention.

FIG. 16 illustrates a routine for controlling the fuel injection and this routine is processed by sequential interruptions executed at 180° CA.

At step 230, it is determined whether or not the measure flag $F_d$ is set. When $F_d$ is reset, the routine goes to step 236, the fuel injection time $\tau_i$ at each fuel injector is set, and the fuel injection is carried out at a predetermined crank angle. Namely, when $F_d$ is reset, the fuel injection time corresponding to each fuel injector is set, and thus all of the fuel injectors inject fuel. When $F_d$ is set, the routine goes to step 231 and it is determined whether or not the fuel injection is for the i-th fuel injector corresponding to i-th cylinder. When the determination is negative, the routine goes to step 232, the fuel injection time is set, and thus a fuel injection is carried out at a predetermined crank angle. When the determination is affirmative, step 232 is skipped, and accordingly, a fuel injection by only the i-th fuel injector is not carried out.

At step 233, it is determined whether or not the counter $C_m$ is equal to 0. When $C_m$ is not equal to 0, the routine goes to step 234 and $C_m$ is decremented by 1. Namely, $C_m$ is decremented by 1 at each 180° CA. When $C_m$ is equal to 0, the routine is completed. At step 235, the basic amount $Q_a$ of fuel to be injected is added to $Q_c$.

Returning to FIGS. 15A through 15C, at step 209, when $C_m$ is equal to 0, i.e., each fuel injector other than the i-th fuel injector has injected fuel three times (since $C_{mo}$ is 12), $K_{pi}$ is renewed from step 210 to step 220.

At step 210, the fuel pressure $P_r$ in the reservoir tank 7 at this time is stored as a measuring finish fuel pressure $P_2$ (see FIG. 14). Then, at step 211, the difference $P_d$ between $P_1$ and $P_2$ is calculated, and at step 212, a total actual amount $Q_{pgi}$ of fuel to be injected under a condition wherein a fuel injection by the i-th fuel injector is prohibited, is calculated from the following equation.

$$Q_{pgi} = P_d \cdot 1/k$$

Where K is a predetermined constant coefficient. First, since i is equal to 1, the total actual amount $Q_{pg1}$ of fuel to be injected, under a condition wherein a fuel injection by the first fuel injector is prohibited, is calculated from the following equation.

$$Q_{pg1} = P_d \cdot 1/k$$

At step 213, an assumed total amount $Q_{pi}$ of fuel to be actually injected by the i-th fuel injector is calculated from the following equation.

$$Q_{pi} = Q_c - Q_{pgi}$$

Since the average correction coefficient $K_p$ has been renewed, it is assumed that the total actual amount $Q_p$ of fuel to be injected, when all of fuel injectors inject fuel, is equal to the cumulation calculated target amount $Q_c$ of fuel to be injected. Accordingly, $Q_c - Q_{pgi}$ is equal to the assumed total amount $Q_{pi}$ of fuel to be actually injected by the i-th fuel injector. At step 214, a cumulation calculated target amount $Q_{ci}$ of fuel to be injected from one fuel injector is calculated by dividing the cumulation calculated target amount $Q_c$ of fuel to be injected by the number of fuel injectors, i.e., 4. At step 215, a provisional correction coefficient $K_{pni}$ of each fuel injector is calculated from the following equation.

$$K_{pni} = K_{pi} \cdot Q_{ci}/Q_{pi}$$

Where, for example, if the cumulation calculated target amount $Q_{ci}$ of fuel to be injected by the i-th fuel injector is equal to 100, and the assumed total amount $Q_{pi}$ of fuel to be actually injected by the i-th fuel injector is equal to 95, $K_{pni}$ is equal to $K_{pi} \cdot 100/95$, and thus the provisional correction coefficient $K_{pni}$ of each fuel injector is increased. $K_{pi}$ is calculated on the basis of $K_{pni}$, and accordingly, $K_{pi}$ is increased as $K_{pni}$ is increased. Therefore, since the fuel injection time $\tau_i$ corresponding to the i-th fuel injector is increased, i.e., an actual amount of fuel to be injected by the i-th fuel injector is increased (see step 162 in FIG. 9), $Q_p$i can be made equal to $Q_c$.

At step 216, the renewed value of $K_{pi}$ is calculated from the following expression, and stored as $K_{pi}$.

$$K_{pi} + (K_{pni} - K_{pi})/M$$

This expression can be rewritten by the following expression.

$$\{(M-1)\,K_{pi} + K_{pni}\}/M$$

As shown by this expression, $K_{pi}$ is weighted by $(M-1)$ and $K_{pni}$ is weighted by 1.

As described above, when $K_{p1}$ corresponding to the first fuel injector is renewed, the routine goes to step 217 and i is incremented by 1. Then, at step 218, the renewal flag $F_B$ and the measure flag $F_d$ are reset. When $F_d$ is reset, the fuel injection of the i-th fuel injector can be carried out, i.e., all of the fuel injectors inject fuel (see FIG. 16). At step 222, it is determined whether or not i is equal to 5. Since i is equal to 2, step 220 is skipped and the routine is completed.

In the next processing cycle, since it is determined that $F_B$ is equal to 0, the routine goes to step 205. When $P_r$ becomes equal to or larger than $P_a$, the routine goes to step 206 and the correcting coefficient $K_{p2}$ of the second fuel injector is renewed.

When $K_{p1}'$, $K_{p2}'$, $K_{p3}'$ and $K_{p4}'$ are calculated since i becomes equal to 5, the routine goes to step 220 and $K_{p1}$, $K_{p2}$, $K_{p3}$ and $K_{p4}$ are renewed. Note, because, if $K_{p2}'$ is calculated after $K_{p1}$ has been renewed, $K_{p3}'$ is calculated after $K_{p2}$ has been renewed, and $K_{p4}'$ is calculated after $K_{p3}$ has been renewed, $K_{p2}'$, $K_{p3}'$ and $K_{p4}'$ can not be precisely calculated. Accordingly, after $K_{p1}'$, $K_{p2}'$, $K_{p3}'$ and $K_{p4}'$ are calculated, $K_{p1}$, $K_{p2}$, $K_{p3}$ and $K_{p4}$ are renewed at the same time, whereby $K_{pi}$ can be precisely renewed.

As mentioned above, according to the second embodiment of the present invention, the fuel pressure drop in the reservoir tank 7 caused by a plurality of fuel injections is detected, while the fuel supply to the reservoir tank 7 is stopped. Accordingly, since fluctuations of the fuel pressure in the reservoir tank 7 become small, relative to the fuel pressure drop in the reservoir tank 7, the fuel pressure drop in the reservoir tank 7 can be precisely detected. Therefore, the actual amount of fuel to be injected can be precisely determined, and thus the actual total amount of fuel to be injected can be made identical to the total of the target amount of fuel to be injected.

Further, in the second embodiment, since each correction coefficient corresponding to each fuel injector, respectively, is calculated, the actual amount of fuel to be injected by each fuel injector can be made identical to the target amount of fuel to be injected.

A third embodiment of the present invention is now described with reference to FIGS. 17 through 20, and is applied to an engine similar to that illustrated in FIG. 1.

Figure 17:
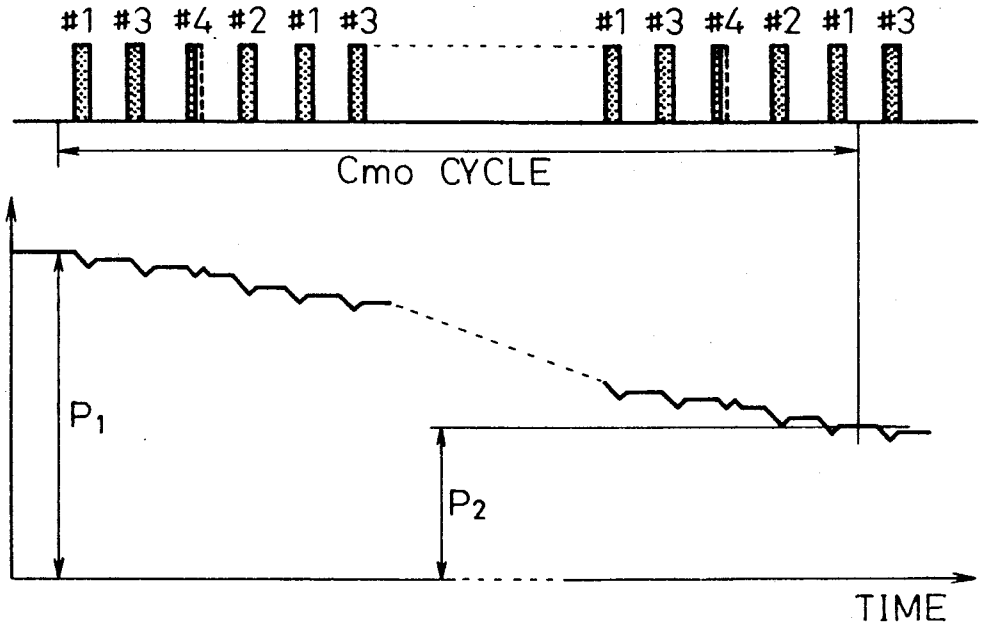
FIG. 17 is a time chart illustrating a fuel injection timing and the change of fuel pressure in the reservoir tank when $K_{pi}$ is renewed according to the third embodiment of the present invention.

FIG. 17 illustrates a fuel injection timing of the fuel injectors 5 and the change of pressure in the fuel in the reservoir tank 7 when $K_{pi}$ is renewed, according to in the third embodiment of the present invention. In this embodiment, $K_{pi}$ is renewed by stopping the fuel supply to the reservoir tank 7 and reducing the amount of fuel to be injected corresponding to only one of the four fuel injectors.

Figure 18:
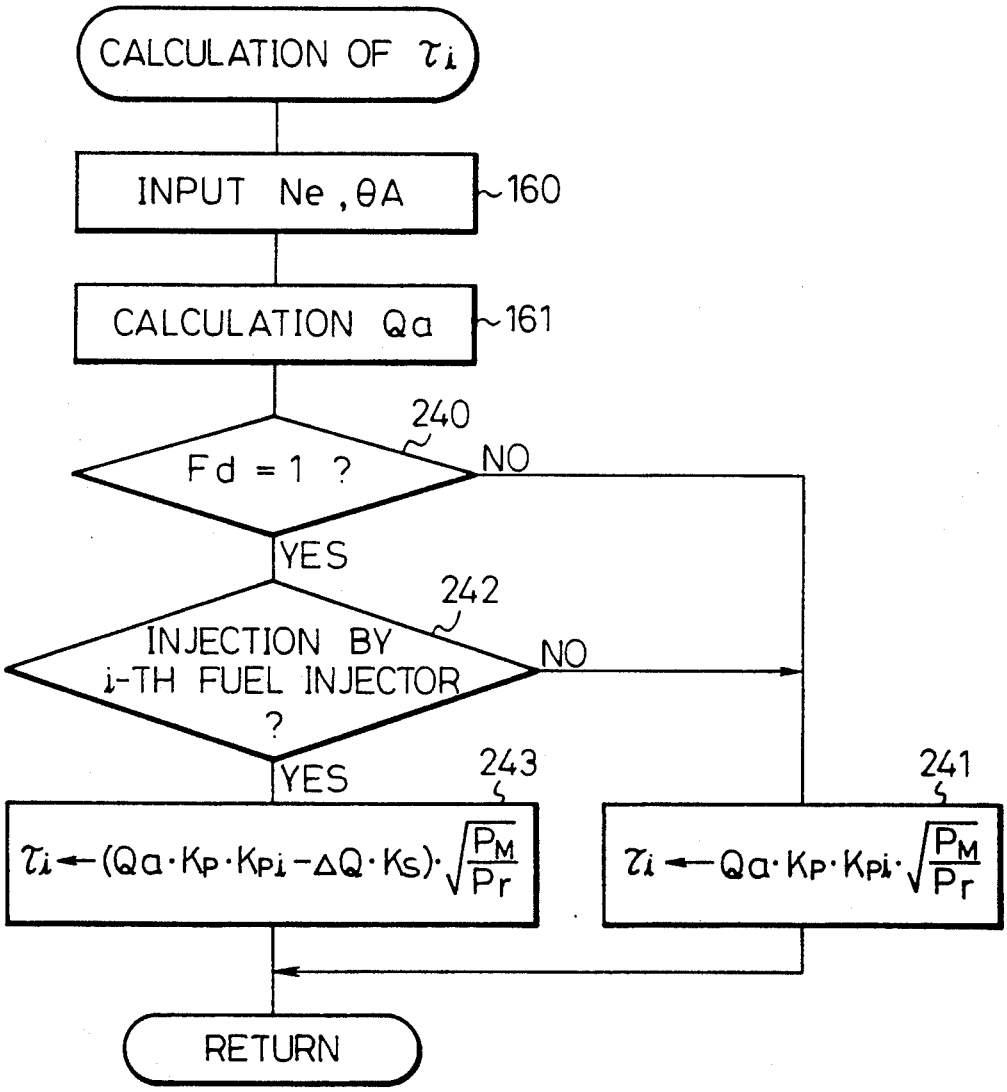
FIG. 18 is a flow chart for calculating a fuel injection time $\tau_i$ of each fuel injector according to the third embodiment of the present invention.

FIG. 18 illustrates a routine for calculating each fuel injection time $\tau_i$ corresponding to each fuel injector 5, and this routine is processed by sequential interruptions executed at predetermined crank angles. In FIG. 18, the same steps are indicated by the same step numbers used in FIG. 13, and thus descriptions thereof are omitted.

At step 240, it is determined whether or not the measure flag $F_d$ is set. When $F_d$ is reset, the routine goes to step 241 and each fuel injection time $\tau_i$ corresponding to each fuel injector 5 of each cylinder is calculated from the following equation.

$$\tau_i = Q_a \cdot K_p \cdot K_{pi} \cdot \sqrt{\frac{P_M}{P_r}}$$

When $F_d$ is set, the routine goes to step 242 and it is determined whether or not the fuel injection is for the i-th fuel injector. When the result is no, the routine goes to step 241 and $\tau_i$ is calculated from the following equation.

$$\tau_i = Q_a \cdot K_p \cdot K_{pi} \cdot \sqrt{\frac{P_M}{P_r}}$$

When the result is yes at step 242, the routine goes to step 243 and $\tau_i$ is calculated from the following equation.

$$\tau_i = (Q_a \cdot K_p \cdot K_{pi} - \Delta Q \cdot K_s) \cdot \sqrt{\frac{P_M}{P_r}}$$

Where $\Delta Q$ is a reduction value, for example, is equal to $Q_a/2$, and $K_s$ is a predetermined constant coefficient for converting the amount of fuel to be injected into the fuel injection time.

Namely, when the fuel injection is for the i-th fuel injector, the amount of fuel to be injected from the i-th fuel injector is reduced by $\Delta Q$.

Figure 19:
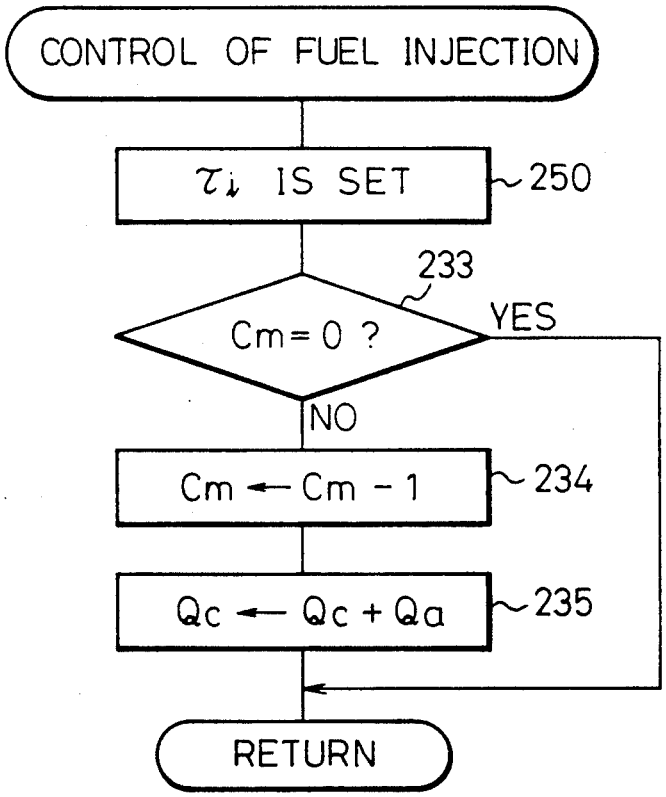
FIG. 19 is a flow chart for controlling the fuel injection according to the third embodiment of the present invention.

FIG. 19 illustrates a routine for controlling the fuel injection, and this routine is processed by sequential interruptions executed at 180° CA. In FIG. 19, the same steps are indicated by the same step numbers used in FIG. 16, and thus descriptions thereof are omitted.

At step 250, the fuel injection time $\tau_i$ is set and the fuel injection is carried out at a predetermined crank angle.

Figures 20, 20A:
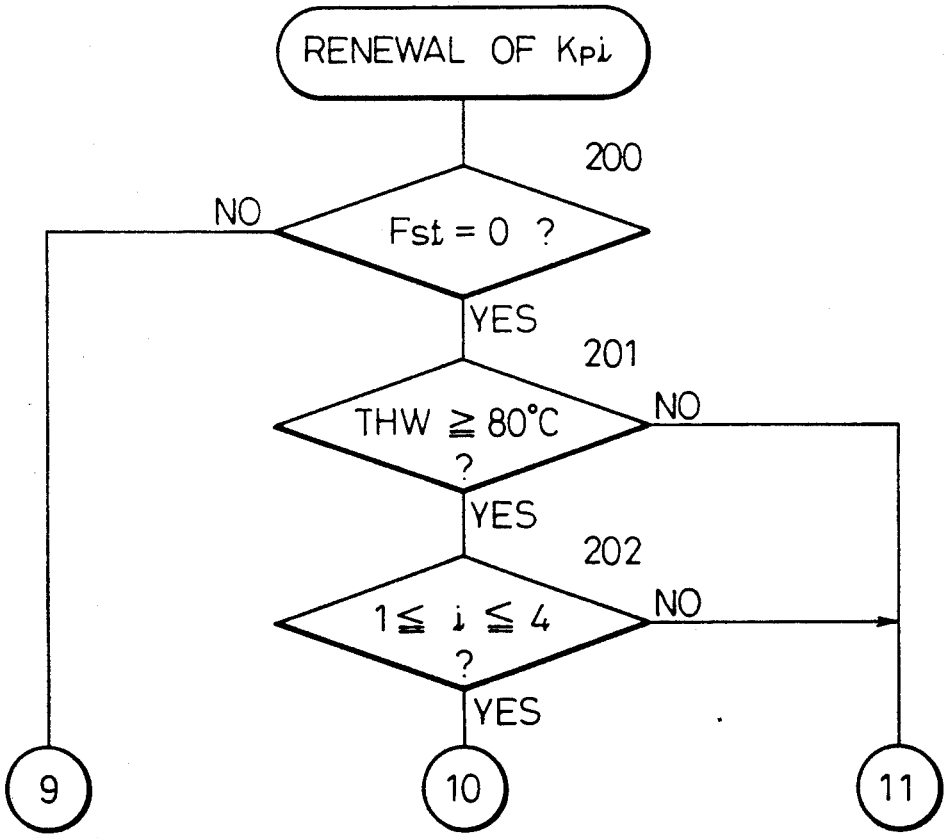
FIGS. 20, 20A, 20B, and 20C are flow charts for renewing a correction coefficient $K_{pi}$ of each fuel injector according to the third embodiment of the present invention.
Figure 20B:
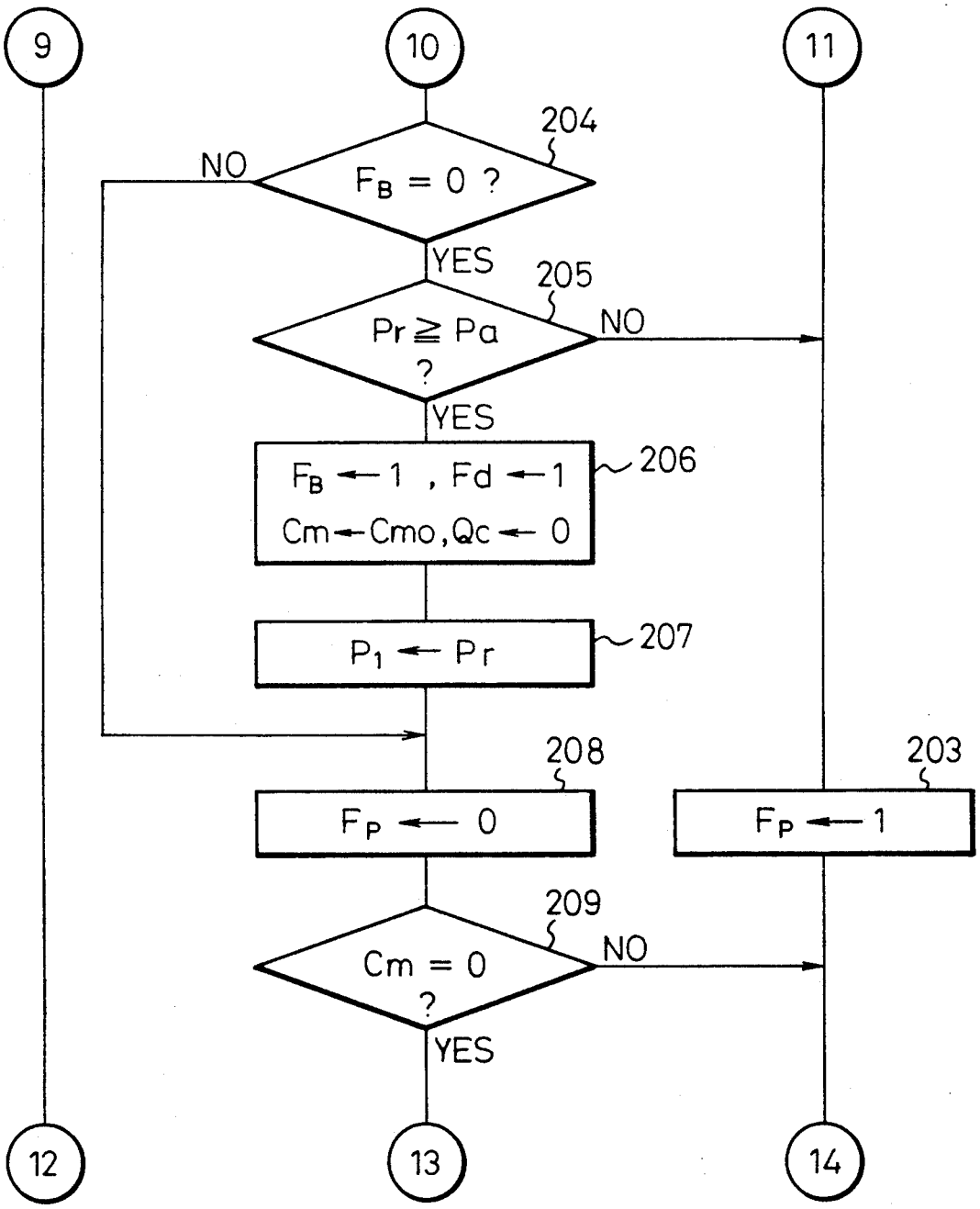
Figure 20C:
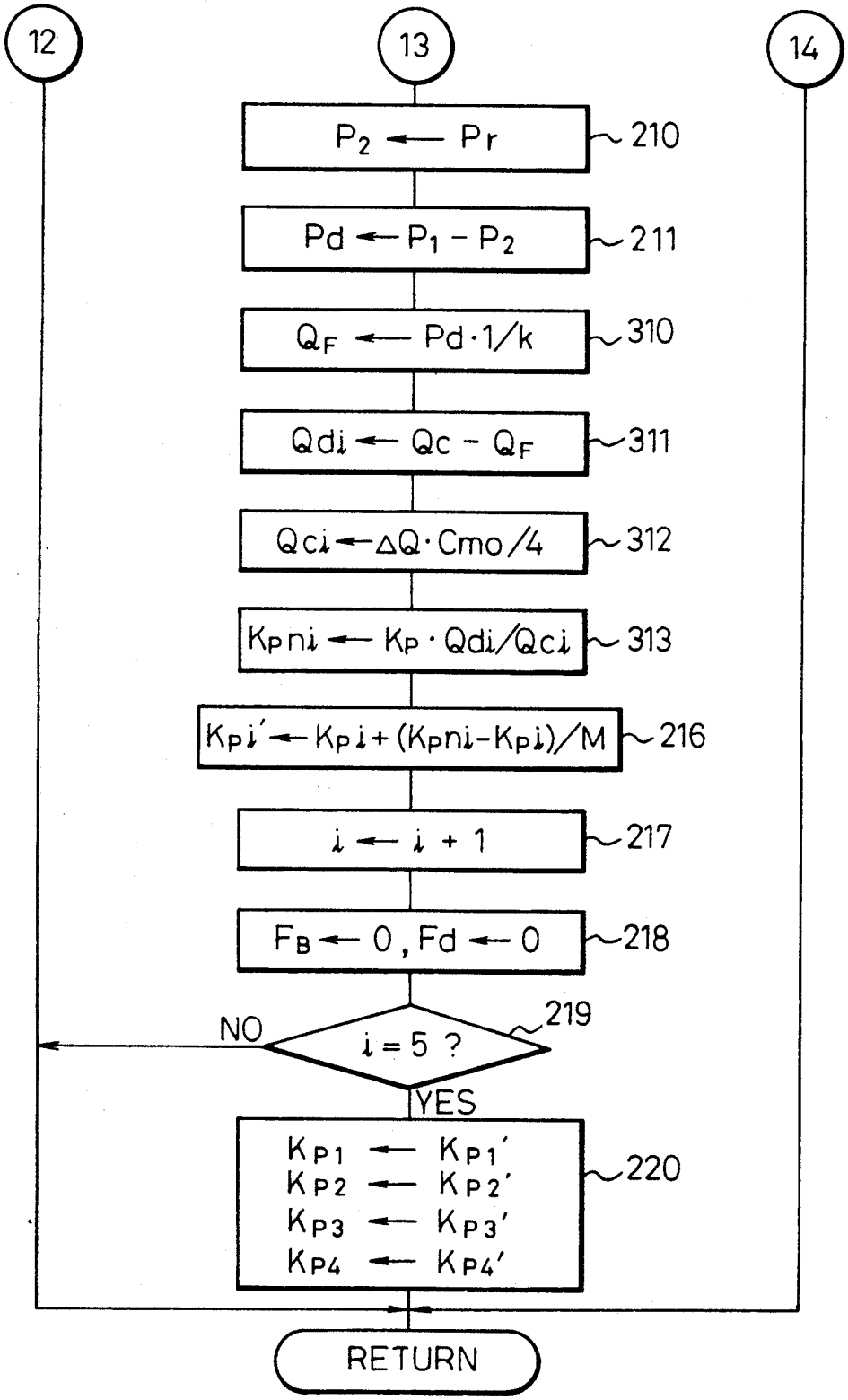

FIGS. 20A through 20C illustrate a routine for renewing $K_{pi}$, and this routine is processed by sequential interruptions executed at predetermined intervals. In FIGS. 20A through 20C, the same steps are indicated by the same step numbers used in FIGS. 15A through 15C, and thus descriptions thereof are omitted.

At step 310, a total actual amount $Q_F$ of fuel to be injected, when the amount of fuel to be injected by the i-th fuel injector is reduced by $\Delta Q$, is calculated from the following equation.

$$Q_F = P_d \cdot 1/k$$

where k is a predetermined constant coefficient.

At step 311, a total actual reduction amount $Q_{di}$ of fuel corresponding to the i-th fuel injector is calculated from the following equation.

$$Q_{di} = Q_c - Q_F$$

Since the average correction coefficient $K_p$ has been renewed, it is assumed that the total actual amount of fuel to be injected when all of the fuel injectors normally inject fuel is equal to the cumulation calculated target amount $Q_c$ of fuel to be injected. Accordingly, $Q_c - Q_F$ is equal to the total actual reduction amount $Q_{di}$ of fuel corresponding to the i-th fuel injector.

At step 312, a total amount $Q_{ci}$ of the reduction value $\Delta Q$ corresponding to the i-th fuel injector is calculated from the following equation.

$$Q_{ci} = \Delta Q \cdot C_{mo}/4$$

A fuel injection number corresponding to the i-th fuel injector is calculated by dividing the total fuel injection number $C_{mo}$, which is a multiple of 4, by the number of cylinders, i.e., 4, and accordingly, $\Delta Q \cdot C_{mo}/4$ represents the total amount of the reduction value $\Delta Q$.

At step 313, the provisional correction coefficient $K_{pni}$ is calculated from the following equation.

$K_{pni}=K_p \cdot Q_{di}/Q_{ci}$ where for example, if the total actual reduction amount $Q_{di}$ of fuel corresponding to the i-th fuel injector is equal to 8 and the total amount $Q_{ci}$ of the reduction value $\Delta Q$ corresponding to the i-th fuel injector is equal to 10, $K_{pni}$ is equal to $K_p \cdot 8/10$, and thus the provisional correction coefficient $K_{pni}$ of each fuel injector is reduced. $K_{pi}$ is calculated on the basis of $K_{pni}$, and accordingly, $K_{pi}$ is reduced as $K_{pni}$ is reduced. Therefore, since the fuel injection time $\tau_i$ corresponding to the i-th fuel injector is reduced, i.e., an actual amount of fuel to be injected from the i-th fuel injector is reduced, $Q_{di}$ can be made equal to $Q_{ci}$. Namely, the actual amount of fuel to be injected can be made identical to the target amount of fuel to be injected.

As mentioned above, the third embodiment of the present invention obtains an effect similar to that obtained by the second embodiment.

Further, in the third embodiment, since the fuel injection of the i-th fuel injector is not prohibited (the amount of fuel to be injected by the i-th fuel injector is reduced), fluctuations of the engine torque can be reduced.

Note, in this embodiment, although the amount of fuel to be injected by the i-th fuel injector is reduced by $\Delta Q$, the amount of fuel to be injected by the i-th fuel injector can be increased by $\Delta Q$.

Although the invention has been described with reference to specific embodiments chosen for purposes of illustration, it should be apparent that numerous modifications can be made thereto without departing from the basic concept and scope of the invention.

I claim:

1. A fuel injection device for an internal combustion engine having a fuel injector connected to a discharge port of a fuel supply pump, via a fuel passage, said device comprising:

a calculating means for calculating a target amount of fuel to be injected, based on an engine speed and an engine load;

a fuel pressure detecting means for detecting a fuel pressure in the fuel passage;

a fuel supply stopping means for stopping a supply of fuel from the fuel supply pump to the fuel passage;

a fuel pressure drop detecting means for detecting a drop in the fuel pressure in the fuel passage caused by a plurality of a fuel injection, on the basis of an output of said fuel pressure detecting means, while a supply of fuel by said fuel supply stopping means is stopped;

an actual total amount of a fuel injection determining means for determining an actual total amount of fuel to be injected, based on the fuel pressure drop detected by said fuel pressure drop detecting means;

a correction means for correcting an amount of fuel to be injected to make said actual total amount of fuel injection identical to a total of said target amount of fuel to be injected, based on a result of a determination of said actual total amount of a fuel injection by said determining means; and a fuel supply starting means for starting a supply of fuel from the fuel supply pump to the fuel passage when said fuel pressure drop detecting means detects a drop in the fuel pressure.

2. A fuel injection device according to claim 1, wherein said engine load corresponds to a degree of opening of an accelerator pedal.

3. A fuel injection device according to claim 1, wherein said fuel supply stopping means stops the supply of fuel when an engine coolant temperature is higher than a predetermined temperature and an engine running state is an idling engine running state.

4. A fuel injection device according to claim 1, wherein said fuel supply stopping means stops the supply of fuel only once, each time the engine is started.

5. A fuel injection device according to claim 1, wherein said fuel supply starting means starts a supply of fuel from the fuel supply pump to the fuel passage when the fuel pressure in the fuel passage becomes lower than a predetermined pressure.

6. A fuel injection device according to claim 1, wherein said fuel pressure drop is represented by a difference between a pressure immediately after said fuel supply stopping means has stopped the supply of fuel and a pressure immediately before said fuel supply starting means has started to supply fuel.

7. A fuel injection device according to claim 1, wherein said actual total amount of a fuel injection determining means determines said actual total amount of fuel to be injected by multiplying said fuel pressure drop by a predetermined constant coefficient.

8. A fuel injection device according to claim 1, further comprising an additional correction means for correcting an amount of fuel to be injected, based on said fuel pressure detected by said fuel pressure detecting means.

9. A fuel injection devices according to claim 1, wherein said correction means corrects the amount of fuel to be injected by multiplying the amount of fuel to be injected by a correction coefficient, said correction coefficient being calculated on the basis of said actual total amount of fuel to be injected.

10. A fuel injection device according to claim 9, wherein said correction coefficient is increased as a ratio of said total of the target amount of fuel to be injected to said actual total amount of fuel to be injected is increased.

11. A fuel injection device according to claim 1, wherein the engine has a plurality of fuel injectors corresponding to a plurality of engine cylinders, further comprising:

a second fuel supply stopping means for stopping a supply of fuel from the fuel supply pump to the fuel passage when said fuel pressure in the fuel passage detected by said fuel pressure detecting means becomes higher than a predetermined pressure after said fuel supply starting means has started a supply of fuel from the fuel supply pump to the fuel passage;

an amount of fuel increasing or reducing means for increasing or reducing the amount of fuel to be injected corresponding to one fuel injector of the plurality of fuel injectors, by a predetermined increase or reduction in the amount of fuel while said second fuel supply stopping means has stopped the supply of fuel;

a fuel pressure drop second detecting means for detecting the fuel pressure drop caused by fuel injections, based on an output of said fuel pressure detecting means while said second fuel supply stopping means has stopped the supply of fuel;

an actual increase or reduction amount calculating means for calculating an actual increase or reduction in an amount of fuel to be injected corresponding to said one fuel injector, on the basis of the fuel pressure drop detected by said fuel pressure drop second detecting means;

a second correction means for correcting an amount of fuel to be injected corresponding to said one fuel injector, to thereby make the actual amount of fuel to be injected corresponding to said one fuel injector identical to said target amount of fuel to be injected, on the basis of a result obtained by said actual increase or reduction amount calculating means and said predetermined increase or reduction in the amount of fuel; and a second fuel supply starting means for starting a supply of fuel from the fuel supply pump to the fuel passage when said fuel pressure drop second detecting means has detected said fuel pressure drop.

12. A fuel injection device according to claim 11, wherein said second fuel supply stopping means stops the supply of fuel when an engine coolant temperature is higher than a predetermined temperature.

13. A fuel injection device according to claim 11, wherein said predetermined increase or deduction in an amount of fuel is a half of said target amount of fuel to be injected.

14. A fuel injection device according to claim 11, wherein said fuel pressure drop detected by said fuel pressure drop second detecting means is represented by a difference between a pressure immediately after said second fuel supply stopping means has stopped the supply of fuel and a pressure immediately after a predetermined number of fuel injections have been carried out.

15. A fuel injection device according to claim 11, wherein said actual increase or reduction amount calculating means calculates said actual increase or reduction in an amount of fuel to be injected corresponding to said one fuel injector by multiplying said fuel pressure drop detected by said fuel pressure drop second detecting means by a predetermined constant coefficient.

16. A fuel injection device according to claim 11, wherein said second fuel supply stopping means stops said supply of fuel when said fuel pressure in the fuel passage detected by said fuel pressure detecting means becomes higher than a predetermined pressure after said second fuel supply starting means has started a supply of fuel from the fuel supply pump to the fuel passage.

17. A fuel injection device according to claim 16, wherein said second correction means corrects the amount of fuel to be injected by multiplying the amount of fuel to be injected by a correction coefficient of each fuel injector, said correction coefficient being calculated on the basis of a result obtained by said actual increase or reduction amount calculating means and said predetermined increase or reduction in an amount of fuel.

18. A fuel injection device according to claim 17, wherein said correction coefficient of each fuel injector is increased as a ratio of said actual increase or reduction in an amount of fuel to be injected to said predetermined increase or reduction in an amount of fuel.

19. A fuel injection device according to claim 17, wherein all of said correction coefficients corresponding to each fuel injector are calculated.

20. A fuel injection device according to claim 19, wherein all of said correction coefficients are renewed at one time.

21. A fuel injection device according to claim 1, wherein the engine has a plurality of fuel injectors corresponding to a plurality of engine cylinders, further comprising:

a second fuel supply stopping means for stopping a supply of fuel from the fuel supply pump to the fuel passage when said fuel pressure in the fuel passage detected by said fuel pressure detecting means becomes higher than a predetermined pressure after said fuel supply starting means has started a supply of fuel from the fuel supply pump to the fuel passage;

a fuel injection stopping means for stopping a fuel injection by one fuel injector among said plurality of fuel injectors while said second fuel supply stopping means has stopped the supply of fuel;

a fuel pressure drop second detecting means for detecting a fuel pressure drop caused by fuel injections, based on an output of said fuel pressure detecting means while said second fuel supply stopping means has stopped the supply of fuel;

an actual amount of fuel injection determining means for determining an actual amount of fuel to be injected corresponding to said one fuel injector on the basis of the fuel pressure drop detected by said fuel pressure drop second detecting means;

a second correction means for correcting an amount of fuel to be injected corresponding to said one fuel injector to thereby make the actual amount of fuel to be injected corresponding to said one fuel injector identical to said target amount of fuel to be injected, on the basis of a result obtained by said actual amount of fuel injection determining means; and a second fuel supply starting means for starting a supply of fuel from the fuel supply pump to the fuel passage when said fuel pressure drop second detecting means has detected said fuel pressure drop.

* * * * *

UNITED STATES PATENT AND TRADEMARK OFFICE

CERTIFICATE OF CORRECTION

PATENT NO. : 5,176,122

DATED : January 5, 1993

INVENTOR(S) : Yasushi ITO

It is certified that error appears in the above-identified patent and that said Letters Patent is hereby corrected as shown below:

Column 5, line 2, change "is" to --are--.

Column 6, line 11, delete "and" between "116" and "are".

Column 11, line 7, change "or" to --at--.

Column 16, line 34, change "devices" to --device--.

Column 17, line 25, change "deduction" to --reduction--.

Signed and Sealed this

Twenty-second Day of February, 1994

Bruce Lehman

*Attest:*

BRUCE LEHMAN

*Attesting Officer*

*Commissioner of Patents and Trademarks*